US010081994B2

(12) United States Patent
Imler et al.

(10) Patent No.: US 10,081,994 B2
(45) Date of Patent: Sep. 25, 2018

(54) SCREENED ENCLOSURE WITH VACUUM PORTS FOR USE IN A VACUUM-BASED DRILLING FLUID RECOVERY SYSTEM

(71) Applicant: FP Marangoni Inc., Leduc, Alberta (CA)

(72) Inventors: Alan Robert Imler, Calgary (CA); Derek Joseph Lowe, Calgary (CA); Dennis Lynn Jackson, Jr., Brighton, CO (US)

(73) Assignee: FP Marangoni Inc., Calgary (CA)

( * ) Notice: Subject to any disclaimer, the term of this patent is extended or adjusted under 35 U.S.C. 154(b) by 9 days.

(21) Appl. No.: 15/005,568

(22) Filed: Jan. 25, 2016

(65) Prior Publication Data

US 2016/0220929 A1 Aug. 4, 2016

Related U.S. Application Data

(60) Provisional application No. 62/189,325, filed on Jul. 7, 2015, provisional application No. 62/110,205, filed on Jan. 30, 2015.

(51) Int. Cl.
*E21B 21/00* (2006.01)
*E21B 21/06* (2006.01)

(52) U.S. Cl.
CPC ..... *E21B 21/065* (2013.01)

(58) Field of Classification Search
None
See application file for complete search history.

(56) References Cited

U.S. PATENT DOCUMENTS

| | | | | |
|---|---|---|---|---|
| 2,161,500 | A | 6/1939 | Bird et al. | |
| 2,462,878 | A | 3/1949 | Logue | |
| 2,835,387 | A | 5/1958 | Fontein | |
| 3,520,300 | A * | 7/1970 | Guiles, Jr. ..... | A61M 1/008 433/91 |
| 3,713,499 | A | 1/1973 | Arscott et al. | |

(Continued)

FOREIGN PATENT DOCUMENTS

| | | | |
|---|---|---|---|
| CA | 970724 | A | 7/1975 |
| CA | 2557934 | A1 | 11/2005 |

(Continued)

OTHER PUBLICATIONS

International Search Report Application No. PCT/CA2016/050070 Completed: Apr. 27, 2016; dated May 3, 2016 7 pages.

(Continued)

*Primary Examiner* — Chester T Barry
(74) *Attorney, Agent, or Firm* — Whitmyer IP Group LLC

(57) ABSTRACT

A screened vacuum enclosure for use in separating drilling fluid from drill cuttings in a vacuum-based shaker system, the screened vacuum enclosure including: a) a rectangular frame including downstream and upstream longitudinal outer frame members and transverse outer frame members, with one or more vacuum ports extending through or into one of the longitudinal outer frame members, the vacuum ports communicating vacuum suction to the interior of the screened vacuum enclosure; b) one or more inner frame support members connected to the outer frame members; c) a screen attached to the top surface of the frame; and d) a floor attached to at least part of the bottom surface of the frame.

30 Claims, 27 Drawing Sheets

(56) References Cited

U.S. PATENT DOCUMENTS 3,774,702 A 11/1973 Elenburg
3,815,473 A 6/1974 Jones, Jr.
3,888,352 A 6/1975 Kulseth
3,895,927 A 7/1975 Boumham
3,929,642 A 12/1975 Ennis et al.
3,943,233 A * 3/1976 Swanson ..... B01D 33/04 210/401
3,970,552 A 7/1976 Bongert
4,094,492 A 6/1978 Beeman et al.
4,113,452 A 9/1978 Brown et al.
4,154,686 A * 5/1979 Ootani ..... B01D 33/333 198/833
4,246,013 A 1/1981 Truhan et al.
4,279,743 A 7/1981 Miller
4,298,572 A 11/1981 Moffet et al.
4,350,591 A 9/1982 Lee
4,397,659 A 8/1983 Gowan et al.
4,492,862 A 1/1985 Grynberg et al.
4,546,783 A 10/1985 Lott
4,635,735 A 1/1987 Crownover
4,639,258 A 1/1987 Schellstede et al.
4,725,352 A 2/1988 Haliotis
4,729,404 A * 3/1988 Hergenroeder ..... A61G 10/00 137/312
4,750,920 A 6/1988 Manuel et al.
4,764,287 A 8/1988 Colman et al.
4,872,988 A 10/1989 Culkin
4,886,608 A 12/1989 Cook
4,971,685 A 11/1990 Stanley et al.
5,032,184 A * 7/1991 Ogilvie ..... A47L 5/38 134/21
5,098,586 A 3/1992 Rudolph
5,332,500 A 7/1994 Seureau et al.
5,341,882 A 8/1994 Hale
5,431,882 A 7/1995 Nokihara et al.
5,437,651 A * 8/1995 Todd ..... A61M 1/0088 15/420
5,462,673 A 10/1995 Piers
5,655,258 A * 8/1997 Heintz ..... A47L 7/0009 15/415.1
5,827,246 A * 10/1998 Bowen ..... A61M 1/008 604/313
5,857,522 A 1/1999 Bradfield et al.
5,996,484 A 12/1999 Reddoch
6,092,390 A 7/2000 Griffith, Jr.
6,106,733 A 8/2000 Wood
6,136,098 A * 10/2000 Tribastone ..... A47L 7/0009 134/21
6,155,429 A 12/2000 Clark
6,164,380 A 12/2000 Davis
6,170,580 B1 1/2001 Reddoch
6,348,087 B1 2/2002 Aslin
6,389,818 B2 5/2002 Cho et al.
6,389,878 B1 5/2002 Zamfes
6,443,001 B1 9/2002 Duriez et al.
6,474,289 B1 11/2002 Lilly et al.
6,513,192 B1 * 2/2003 Pearlstein ..... A47L 7/0009 15/415.1
6,607,659 B2 8/2003 Hensley et al.
6,845,868 B1 1/2005 Krush et al.
7,096,942 B1 8/2006 de Rouffignac et al.
7,392,138 B2 6/2008 Frechin et al.
7,704,299 B2 4/2010 Mueller et al.
7,727,316 B2 6/2010 Mueller et al.
7,740,761 B2 6/2010 Bailey
7,767,628 B2 8/2010 Kippie et al.
7,841,477 B2 11/2010 Hansen
8,276,686 B2 10/2012 James
8,394,270 B2 3/2013 Vasshus et al.
8,613,360 B2 12/2013 Carr
8,691,097 B2 4/2014 McCabe
9,004,288 B2 4/2015 Carr
9,015,959 B2 4/2015 Pomerleau
9,074,440 B2 7/2015 Carr
2002/0056667 A1 * 5/2002 Baltzer ..... B01D 33/0376 209/405
2003/0131700 A1 7/2003 Balz et al.
2003/0168211 A1 9/2003 Arnaud et al.
2003/0168391 A1 9/2003 Tveiten
2004/0154963 A1 8/2004 Raybom
2005/0082236 A1 4/2005 Derrick et al.
2005/0183994 A1 8/2005 Hensley et al.
2006/0016768 A1 1/2006 Grichar et al.
2006/0113220 A1 6/2006 Scott
2006/0254421 A1 11/2006 Boone
2007/0169540 A1 7/2007 Sterner et al.
2007/0245839 A1 10/2007 Rieberer
2008/0078699 A1 4/2008 Carr
2008/0078700 A1 4/2008 Jones et al.
2008/0223777 A1 9/2008 Vasshus et al.
2009/0308819 A1 12/2009 Bailey
2010/0012556 A1 1/2010 Pohle
2010/0181265 A1 7/2010 Schulte, Jr. et al.
2011/0284481 A1 11/2011 Pomerleau
2012/0279932 A1 11/2012 Pomerleau
2013/0074360 A1 3/2013 Pomerleau
2013/0092637 A1 4/2013 Pomerleau
2014/0091028 A1 4/2014 Pomerleau
2015/0048037 A1 * 2/2015 Frazier ..... B07B 1/28 210/808

FOREIGN PATENT DOCUMENTS

CA 2664173 A1 4/2008
CA 2712774 A 11/2010
CN 101553322 A 10/2009
CN 201433729 Y 3/2010
DE 2154840 A1 5/1973
EP 2097612 A1 9/2009
FR 2636669 A1 3/1990
GB 651094 A 3/1951
GB 2089403 A 6/1982
GB 2521373 A 6/2015
KR 200379512 3/2005
KR 100503572 B1 7/2005
NO 2005054623 A1 6/2005
NO 2008042860 A2 4/2008
RU 2021038 C1 10/1994
SU 99315 A1 11/1953
SU 297691 3/1971
SU 391868 A1 7/1973
SU 793647 1/1981
SU 1260505 A1 9/1986
WO 2010048718 A1 5/2010
WO 2011113132 A1 9/2011
WO 2011140635 A2 11/2011
WO 2013040678 A1 3/2013
WO 2014063251 A1 5/2014

OTHER PUBLICATIONS

Written Opinion of the International Searching Authority Application No. PCT/CA2016/050070 Completed: May 2, 2016; dated May 3, 2016 5 pages.
Joint Industry Shaker Technology Committee: "Solids Control Equipment" In: "Shale Shaker and Drilling Fluid Systems"—Dec. 31, 1999; 4 pages.
Office Action from Canada Application No. 2,793,233 dated Oct. 20, 2014 4 pages.
Canadian Office Action dated Dec. 19, 2013 from Canadian Intellectual Property Office regarding Canadian Application No. 2,793,233 filed Oct. 23, 2012.
Second Office Action from China Application No. 201080066711.9 dated Feb. 9, 2015 21 pages.
US District Court File No. 515-cv-00406-DAE—Emergency Motion for Reconsideration—Jun. 26, 2015; 11 pages.
International Preliminary Report on Patentability Application No. PCT/CA2012/000835 dated Mar. 25, 2014 3 pages.
International Preliminary Report on Patentability Application No. PCT/CA2013/050803 dated Apr. 28, 2015 7 pages.

(56) References Cited

OTHER PUBLICATIONS

International Preliminary Report on Patentability Application No. PCT/CA2009/001555 dated May 3, 2011 7 pages.
International Preliminary Report on Patentability Application No. PCT/CA2010/000501 dated Sep. 18, 2012 7 pages.
International Preliminary Report on Patentability Application No. PCT/CA2011/000542 dated Nov. 13, 2012 3 pages.
International Search Report & Written Opinion of the International Searching Authority; Application No. PCT/CA2010/000501; dated May 19, 2010; dated Jul. 20, 2010; 9 pages.
International Search Report & Written Opinion of the International Searching Authority Application No. PCT/CA2011/000542 Completed: Sep. 21, 2011; dated Oct. 25, 2011 12 pages.
International Search Report Application No. PCT/CA2009/001555 Completed: Feb. 1, 2010; dated Feb. 9, 2010 6 pages.
International Search Report Application No. PCT/CA2010/000501 Completed: May 19, 2010; dated Jul. 20, 2010 3 pages.
International Preliminary Report Application No. PCT/CA2015/050564 dated Jul. 27, 2015; dated Jul. 30, 2015 6 pages.
International Search Report Application No. PCT/CA2011/000542 Completed:Sep. 21, 2011; dated Oct. 25, 2011 4 pages.
International Search Report Application No. PCT/CA2013/050803 Completed: Nov. 28, 2013; dated Dec. 6, 2013 3 pages.
International Search Report Application No. PCT/CA2012/000835 Completed: Dec. 20, 2012; dated Jan. 15, 2013 4 pages.
US District Court File No. 515-cv-00406-DAE—Motion for Stay of Preliminary Injunction—Jun. 25, 2015; 23 pages.
Document from Impeachment Proceedings Related to Canadian U.S. Pat. No. 2,712,774; Offer to Settle dated Apr. 9, 2013; 3 pages.
US District Court File No. 515-cv-00406-DAE—Opposition—Jun. 5, 2015; 199 pages.
US District Court File No. 515-cv-00406-DAE—Order Ganting Preliminary Injunction—Jun. 24, 2015; 31 pages.
US District Court File No. 515-cv-00406-DAE—Reply ISO Motion for Reconsideration—Jul. 8, 2015; 75 pages.
US District Court File No. 515-cv-00406-DAE—Reply Brief ISO Preliminary Injunction—Jun. 10, 2015; 247 pages.
US District Court File No. 515-cv-00406-DAE—M-I Resp to Motion to Reconsider—Jun. 10, 2015; 16 pages.
Document from Impeachment Proceedings Related to Canadian U.S. Pat. No. 2,712,774; Reply to Defence and Counterclaim dated Feb. 21, 2013; 7 pages.
Office Action & English Translation Russian Patent Application No. 2012153393 dated Apr. 28, 2015 3 pages.
Office Action from Russia Application No. 2011 120 971 dated Dec. 19, 2013 12 pages (translation included).
Office Action & English Translation Russian Patent Application No. 2011120971 dated May 8, 2013.
Document from Impeachment Proceedings Related to Canadian U.S. Pat. No. 2,712,774; Statement of Claim dated Oct. 26, 2012; 82 pages.
Document from Impeachment Proceedings Related to Canadian U.S. Pat. No. 2,712,774; Statement of Defence and Counterclaim dated Dec. 21, 2012; 13 pages.
English Translation of CN201433729Y—dated Mar. 31, 2010; 5 pages.
English Translation of DE2154840—dated May 10, 1973; 10 pages.
English Translation of FR2636669—dated Mar. 23, 1990; 8 pages.
English Translation of Text of SU 391868—dated Jul. 27, 1973; 1 page.
Office Action from the U.S. Appl. No. 13/622,216 dated Jan. 7, 2014 19 pages.
Office Action from the U.S. Appl. No. 13/674,732 dated Mar. 21, 2014 13 pages.
Office Action from the U.S. Appl. No. 13/658,035 dated Mar. 30, 2015 18 pages.
Office Action from the U.S. Appl. No. 13/098,014 dated Apr. 6, 2012 8 pages.
Office Action from the U.S. Appl. No. 14/100,532 dated Apr. 16, 2015 8 pages.
Office Action from the U.S. Appl. No. 13/674,732 dated Jun. 22, 2015 26 pages.
Office Action from the U.S. Appl. No. 13/098,014 dated Jul. 17, 2015 29 pages.
Office Action from the U.S. Appl. No. 13/551,194 dated Jul. 17, 2015 9 pages.
Office Action from the U.S. Appl. No. 13/658,035 dated Aug. 28, 2015 20 pages.
Office Action from the U.S. Appl. No. 13/098,014 dated Sep. 20, 2013 20 pages.
Office Action from the U.S. Appl. No. 13/551,194 dated Sep. 26, 2013 8 pages.
Office Action from the U.S. Appl. No. 13/551,194 dated Oct. 8, 2014 13 pages.
Office Action from the U.S. Appl. No. 13/674,732 dated Oct. 21, 2013 7 pages.
Office Action from the U.S. Appl. No. 13/098,014 dated Oct. 23, 2014 27 pages.
Office Action from the U.S. Appl. No. 13/622,216 dated Oct. 24, 2014 8 pages.
Office Action from the U.S. Appl. No. 13/098,014 dated Nov. 8, 2012 7 pages.
Office Action from the U.S. Appl. No. 13/674,732 dated Dec. 4, 2014 13 pages.
Office Action from the U.S. Appl. No. 13/551,194 dated Dec. 6, 2012 6 pages.
Office Action from the U.S. Appl. No. 13/098,014 dated Dec. 17, 2013 13 pages.
Written Opinion of the International Searching Authority Application No. PCT/CA2009/001555 Completed: Feb. 5, 2010; dated Feb. 9, 2010 6 pages.
Written Opinion of the International Searching Authority Application No. PCT/CA2010/000501 Completed: Jun. 7, 2010; dated Jul. 20, 2010 6 pages.
Written Opinion of the International Searching Authority Application No. PCT/CA2011/000542 Completed: Sep. 26, 2011; dated Oct. 25, 2011 7 pages.
Written Opinion of the International Searching Authority Application No. PCT/CA2013/050803 Completed: Dec. 3, 2013; dated Dec. 6, 2013 6 pages.
Written Opinion of the International Searching Authority Application No. PCT/CA2012/000835 Completed: Dec. 20, 2012; dated Jan. 15, 2013 5 pages.

* cited by examiner

SCREENED ENCLOSURE WITH VACUUM PORTS FOR USE IN A VACUUM-BASED DRILLING FLUID RECOVERY SYSTEM

CROSS-REFERENCE TO RELATED APPLICATIONS

This application claims priority to U.S. Provisional Patent Application No. 62/110,205 filed Jan. 30, 2015, and U.S. Provisional Patent Application No. 62/189,325 filed Jul. 7, 2015, each of which is incorporated herein by reference in its entirety.

FIELD OF THE INVENTION

The invention is for use in the field of oil and gas drilling operations and provides a device for use in recovering used drilling fluids from drill cuttings.

BACKGROUND OF THE INVENTION

The loss of drilling fluids presents several technological and cost challenges to the energy exploration industry. These challenges generally include the seepage losses of drilling fluids to the formation, the recovery of drilling fluids at surface and/or the disposal of drilling detritus or cuttings that are contaminated with drilling fluid. In the context of this description, "drilling fluid" is both fluid prepared at surface used in an unaltered state for drilling as well as all fluids recovered from a well that may include various contaminants from the well including water and hydrocarbons (both liquid and gas).

During the excavation or drilling process, drilling fluid losses can reach levels approaching 300 cubic meters of lost drilling fluid over the course of a drilling program. With some drilling fluids having values in excess of $1600 per cubic meter, the loss of such volumes of fluids represents a substantial cost to drill operators.

Drilling fluids are generally characterized as either "water-based" or "oil-based" drilling fluids that may include many expensive and specialized chemicals as known to those skilled in the art. As a result, it is desirable that minimal quantities of drilling fluids are lost during a drilling program such that many technologies have been considered and/or employed to minimize drilling fluid losses both downhole and at surface.

Additionally, in some areas the delivery of oil or water for the formulation of drilling fluids can present several costly challenges for some operations; specifically desert, offshore and even some districts where communities will not allow allocation of water for this use.

As noted above, one particular problem is the separation of drilling fluid and any hydrocarbons from the formation that may be adhered to the drill cuttings (collectively "fluids") at the surface. The effective separation of various fluids from drill cuttings has been achieved by various technologies including but not limited to; hydrocyclones, mud cleaners, linear motion shakers, scroll centrifuges, vertical basket centrifuges (VBC), vacuum devices, and vortex separators. As known to those skilled in the art, these devices are typically rented by operators at costs ranging from $1000 to $2000 per day and, as a result, can also represent a significant cost to operators. Thus, the recovery of fluids necessary to recover these costs generally requires that the recovered fluid value is greater than the equipment rental cost in order for the recovery technology to be economically justified. On excavation projects where large amounts of high-cost drilling fluid are being lost (for example in excess of 3 cubic meters per day), daily rental charges for specialized separation equipment can provide favorable economics. In addition, an operator will likely also factor in the environmental effects and/or costs of disposal of drilling fluid contaminated drill cuttings in designing their drilling fluids/drill cutting separation/recovery systems.

Past techniques for separating drilling fluid from drill cuttings have also used liquid spraying systems to deliver "washing" liquids to drill cuttings as they are processed over shaker equipment. Such washing liquids and associated fluid supply systems are used to deliver various washing fluids as the cuttings are processed over a shaker and can include a wide variety of designs to deliver different washing fluids depending on the type of drilling fluid being processed. For example, washing liquids may be comprised of oil, water, or glycol depending on the drilling fluid and drill cuttings being processed over the shaker. Generally, these washing fluids are applied to reduce the viscosity and/or surface tension of the fluids adhered to the cuttings and allow for more fluids to be recovered. However, these techniques have generally not been cost effective for many drilling fluids as the use of diluting fluids often produces unacceptable increases in drilling fluid volume and/or changes in chemical consistency and rheological properties of the drilling fluid.

Thus, while various separation systems are often effective and/or efficient in achieving a certain level of fluids/cuttings separations, each form of separation technology can generally only be efficiently operated within a certain range of conditions or parameters and at particular price points. For example, standard shakers utilizing screens are relatively efficient and consistent in removing a certain amount of drilling fluid from cuttings where, during the typical operation of a shaker, an operator will generally be able to effect drilling fluid/cuttings separation to a level of about 12-40% by weight of fluids relative to the drill cuttings (i.e. 12-40% of the total mass of recovered cuttings is drilling fluid). The range of fluids/cuttings wt % is generally controlled by screen size wherein an operator can effect a higher degree of fluids/cuttings separation by using a larger screen opening (such as 50-75 mesh) and a lower degree of fluids/cuttings separation with a smaller screen opening (such as up to 325 mesh). The trade-off between using a large mesh screen vs. a small mesh screen is the effect of mesh screen size on the quantity of solids passing through the screen and the time required to effect that separation. That is, while an operator may be able to lower the fluids retained on cuttings coming off the shaker with a larger mesh screen (50-75 mesh), the problem with a larger mesh screen is that substantially greater quantities of solids will pass through the screen, that then significantly affect the rheology and density of the recovered fluids and/or require the use of an additional and potentially less efficient separation technology to remove those solids from the recovered drilling fluids. Conversely, using a small mesh screen, while potentially minimizing the need for further downstream separation techniques to remove solids from recovered drilling fluids, results in substantially larger volumes of drilling fluids not being recovered, as they are more likely to pass over the screens hence leading to increased drilling fluids losses and/or require subsequent processing.

Accordingly, in many operations, an operator will condition fluid recovered from a shaker to additional processing with a centrifugal force type device in order to reduce the fluid density and remove as much of the fine solids as possible before re-cycling or reclaiming the drilling fluid. However, such conditioning requires more expensive equipment such as centrifuges, scrolling centrifuges, and hydrocyclones which then contribute to the overall cost of recovery. These processing techniques are also directly affected by the quality of the fluid they are processing, so fluids pre-processed by shakers using a coarse screen will not be as optimized as those received from finer screens.

Furthermore, the performance of centrifuges, hydrocyclones and other equipment are directly affected by the viscosity and density of the feed fluid. As a result, drilling fluid recovery techniques that send heavy, solids-laden fluids to secondary processing equipment require more aggressive techniques such as increased g-forces and/or vacuum to effect separation which will typically cause degradation in the drill cuttings.

Further still, such secondary processing equipment typically cannot process drill cuttings and drilling fluids at the same throughput values of a shaker with the result being that additional separation equipment may be required or storage tanks may be required to temporarily hold accumulated drilling fluid.

Thus, the operator will try to balance the cost of drilling fluid losses with the quality of the fluid that is recovered together with other considerations. While operators will typically have little choice in the quality of the cuttings processing and fluid recovery techniques available, many operators will operate separation equipment to provide recovered drilling fluid density about 200-300 kg/m$^3$ heavier than the density of the circulating fluid in the system. This heavier fluid which would contain significant quantities of fine solids and that, when left in the drilling fluid, will either immediately or over time impair the performance of the drilling fluid or any other type of fluid.

As a result, there continues to be a need for systems that economically increase the volume of fluids recovered from a shaker without negatively impacting the rheological properties of the recovered drilling fluid.

In addition, there has been a need to develop low-cost retrofit technologies that can enhance fluid recovery and do so at a fractional cost level to mechanisms and technologies currently employed. Further, there has been a need for retro-fit technologies that can be utilized on a variety of shakers from different manufactures and that can be used to enhance the operation of existing shakers.

The use of vacuum technology has been one solution to improving the separation of drilling fluids. However, vacuum technologies may also present dust and mist problems in the workplace. With past vacuum techniques there is a need to regularly clean clogged screens with high pressure washes. High pressure washing of screens creates airborne dust and mist hazards to operators. Thus, there continues to be a need for technologies that minimize the requirement for screen washing.

Further still, there has been a need for improved fluid separation systems on the underside of a vacuum screen that allows relatively large volumes of air to be drawn through a vacuum screen to be effectively and efficiently separated from the relatively low volume of drilling fluid being drawn through a vacuum screen. That is, there has been a need for improved fluid/air separation systems.

Further still, there has been a need for retrofit systems that can be adapted to standard shakers without substantial modification to the existing shaking and that allow for quick and easy installation at a job site. In addition, there has been a need for retrofit systems that also allow for ready disassembly of the system for transport and/or maintenance.

As a result, there has also been a need for systems that improve the ability of shaker systems to improve fluid separation at a shaker. Currently used systems typically include a vacuum conduit running from the shaker screen connection to a large recovery tank which is in line with a powerful vacuum system. According to normal operations, the vacuum systems run continuously until the large tanks become filled with recovered drilling fluid, at which point the recovered drilling fluid is pumped out of the recovery tank and conveyed to the main drilling fluid supply vessels which are known as "mud tanks." Improved systems which reduce the complexity of fluid transfer and related energy requirements are desirable.

Various technologies including vacuum technologies have been used in the past for separating drilling fluids from drill cuttings including vibratory shakers.

For example, U.S. Pat. No. 4,350,591 describes a drilling mud cleaning apparatus having an inclined travelling belt screen and degassing apparatus including a hood and blower. U.S. Patent Publication No, 2008/0078700 discloses a self-cleaning vibratory shaker having retro-fit spray nozzles for cleaning the screens. Canadian Patent Application No. 2,664,173 describes a shaker with a pressure differential system that applies a non-continuous pressure across the screen. U.S. Pat. No. 4,639,258 and U.S. Patent Publication Nos. 2014/0110357, 2014/0091028 and 2013/0074360 describe vacuum-assisted shale shakers. U.S. Pat. No. 8,691,097 describes a separating tower with a top vacuum discharge port and a bottom solids discharge port. Other references including U.S. Pat. No. 6,092,390, U.S. Pat. No. 6,170,580, U.S. Patent Publication No. 2006/0113220 and POT Publication No. 2005/054623 describe various other separation technologies. Each of the above-noted references is incorporated herein by reference in entirety.

Vacuum technologies based on shakers are described in U.S. Patent Publication Nos. 2014/0091028, 2013/0092637, 2013/0074360, 2012/0279932 and 2011/0284481, each of which is incorporated herein by reference in entirety.

Thus, while past technologies may be effective to a certain degree in enabling drilling fluid/cuttings separation, it remains desirable to improve aspects of the design and operation of alternative separation devices that enable expedient conveyance of the collected drilling fluid in a convenient and cost-effective manner with minimal equipment requirements.

SUMMARY OF THE INVENTION

One aspect of the present invention is a screened vacuum enclosure for use in separating drilling fluid from drill cuttings in a vacuum-based shaker system, the screened vacuum enclosure comprising:

a. a rectangular frame including downstream and upstream longitudinal outer frame members and transverse outer frame members, with one or more vacuum ports extending through or into one of the longitudinal outer frame members, the vacuum ports communicating vacuum suction to the interior of the screened vacuum enclosure;

b. one or more inner frame support members connected to the outer frame members;

c. a screen attached to the top surface of the frame; and d. a floor attached to at least part of the bottom surface of the frame.

In some embodiments, the vacuum ports extend through the outside front surface of the downstream longitudinal frame member to the interior of the frame.

In some embodiments, the one or more inner frame support members include longitudinal and transverse inner frame members dividing the inside of the rectangular frame into a plurality of interior sections and wherein vacuum pipes are placed in at least some of the vacuum ports, the vacuum pipes having open ends located in at least some of the interior sections.

In some embodiments, the inner frame support members comprise two longitudinal inner frame members and two transverse inner frame members dividing the interior of the rectangular frame into a grid with nine interior sections, and defining three interior longitudinal areas and three interior transverse areas.

In some embodiments, the screened vacuum enclosure includes nine substantially equi-spaced vacuum ports.

In some embodiments, the vacuum ports are round and have interior threaded sidewalls for installation of one or more threaded plugs.

In some embodiments, the screened vacuum enclosure includes nine vacuum pipes with one vacuum pipe placed in each one of the nine vacuum ports.

In some embodiments, one pipe of the nine vacuum pipes terminates in each one of the nine interior sections.

In some embodiments, each of the three transverse areas includes three vacuum pipes of the nine vacuum pipes with one of the three vacuum pipes terminating in each of the three interior sections included in each of the three transverse areas.

In some embodiments, the screened vacuum enclosure includes four vacuum pipes installed in the second, fourth, sixth and eighth vacuum ports of the nine vacuum ports and wherein the plugs are installed in the first, third, fifth, seventh and ninth vacuum ports of the nine vacuum ports.

In some embodiments, each one of the four vacuum pipes extends across the three longitudinal areas and terminates in the longitudinal area adjacent the longitudinal outer frame member opposing the longitudinal outer frame member with the vacuum ports.

In some embodiments, each of the two inner longitudinal frame members includes three equi-spaced channels adjacent the floor to allow vacuum suction to extend to longitudinal sections that do not include the open ends of the vacuum pipes.

In some embodiments, at least some of the outer frame members are at least partially hollow and are joined to form a continuous hollow space within the rectangular frame, and wherein the vacuum ports join the hollow space and communicate vacuum suction to the interior of the screened vacuum enclosure via one or more additional openings in the rectangular frame.

In some embodiments, the additional openings are provided by one or more slots located in one or more of the longitudinal or transverse outer frame members.

In some embodiments, the one or more slots is eight slots substantially equi-spaced across the length of the interior side of the upstream longitudinal outer frame member, and wherein the downstream outer frame member includes six substantially equi-spaced vacuum ports.

In some embodiments, the eight slots have substantially identical lengths and different widths, with widest slots located at the center of the upstream longitudinal member, and with narrowest slots located adjacent to the ends of the upstream longitudinal member.

In some embodiments, the slots each have radiused corners.

In some embodiments, the slots have a total open area greater than the total open area of the plurality of vacuum ports.

In some embodiments, the outer frame has mitered corners and each end of the downstream longitudinal frame member has a vacuum port extending into a corresponding mitered corner of the mitered corners.

In some embodiments, the one or more inner frame support members is seven transverse inner frame support members.

In some embodiments, the screened vacuum enclosure further comprises seven spacer elements located between corresponding transverse inner frame support members and the floor, the spacer elements having a length less than the length of the transverse inner frame support members, thereby providing upstream and downstream spaces between the transverse inner frame support members and the floor.

In some embodiments, the floor covers between about one quarter to about three quarters of the interior area of the rectangular frame and is bounded by the entire length of the downstream longitudinal member, the entire length of an opposing inner longitudinal support member and opposing portions of the transverse outer frame members.

In some embodiments, the floor covers about half of the interior area.

In some embodiments, the one or more slots is provided by a pair of opposing slots located in the portions of the transverse outer frame members, and wherein the transverse outer frame members each have an interior boundary limiting the interior hollow space.

In some embodiments, the interior boundary in each transverse outer frame member is located adjacent to the upstream end of each of the opposing slots.

In some embodiments, the floor has two sloped portions increasing in height from the opposing portions of the transverse outer frame members to a substantially central apex.

In some embodiments, the floor is supported by a central reinforcing member attached to the underside of the floor and the upstream interior area of the rectangular frame not covered by the floor includes one or more transverse inner frame members.

In some embodiments, the one or more vacuum ports is provided by a single vacuum port located in an adapter inserted in a slot in the downstream outer frame member which is open to the interior of the frame.

In some embodiments, the adapter includes (i) an elongated base with a plug portion configured to fit into the slot and (ii) an outward extending funnel-shaped portion terminating with the vacuum port.

In some embodiments, the elongated base is defined by having one or more bolt or screw holes for connection of the adapter to the downstream outer frame member.

In some embodiments, the floor covers between about one quarter to about three quarters of the interior area of the rectangular frame and is bounded by the entire length of the downstream longitudinal member, the entire length of an opposing inner longitudinal support member and opposing portions of the transverse outer frame members.

In some embodiments, the floor covers about half of the interior area.

In some embodiments, the floor has three sloped sections with first and second triangular sections sloping downward from downstream corners of the rectangular frame and a central trapezoidal section sloping downward from the inner longitudinal support member to the downstream longitudinal frame member.

In some embodiments, the downstream longitudinal outer frame member includes a vacuum pressure gauge for displaying vacuum pressure in the hollow space.

Another aspect of the invention is a vacuum shaker system for separation of drilling fluid from drill cuttings, the system comprising:

a. a shaker having a plurality of screen beds including a downstream screen bed and one or more upstream screen beds;
b. a downstream screened vacuum enclosure as described herein placed on the downstream screen bed;
c. a vacuum distributor connected to at least some of the vacuum ports of the downstream screened vacuum enclosure; and
d. a vacuum source connected to the vacuum distributor.

In some embodiments, the system further comprises at least one additional upstream screened vacuum enclosure as recited herein which is substantially identical to the downstream screened vacuum enclosure with the proviso that, in the upstream screened vacuum enclosure, all vacuum pipes or adapters are removed and all vacuum ports are sealed to restrict the function of the upstream screened vacuum enclosure to that of a screen frame only, thereby providing a means to shake drill cuttings at a similar level from the upstream screened vacuum enclosure to the downstream screened vacuum enclosure.

In some embodiments, each one of the upstream screen beds of the shaker holds a separate upstream screened vacuum enclosure having features as defined for the upstream screened vacuum enclosure described herein.

In some embodiments, the system further comprises a wash module connected to two or more of the vacuum ports for pumping of wash fluid into the screened vacuum enclosure to expel obstructions from the hollow space of the screened vacuum enclosure.

Another aspect of the invention is a kit for assembly of a screened vacuum enclosure for use in separating drilling fluid from drill cuttings on a shaker, the kit comprising:

a. outer frame members including two longitudinal outer frame members and two transverse outer frame members, one of the longitudinal outer frame members defined by a series of vacuum ports and both of the transverse outer frame members defined by a plurality of notches;
b. inner frame members including longitudinal inner frame members and transverse inner frame members, the ends of the longitudinal inner frame members configured to fit into the notches of the transverse outer frame members and the lengths of each of the longitudinal members defined by a first set of openings provided for passage and holding of the transverse members and further defined by a second set of openings provided for passage and holding of a plurality of vacuum pipes; and
c. a covering floor structure dimensioned to cover one open side of the outer frame members.

In some embodiments, the kit further comprises a plurality of vacuum pipes dimensioned to enter the vacuum ports and fit through the second set of openings.

In some embodiments, the kit further comprises a second set of inner longitudinal frame members, each containing a set of regularly spaced channels, such that, when the screened vacuum enclosure is assembled and in use in conjunction with a vacuum source and a shaker, vacuum pressure is transmissible through all sections of a grid formed by the inner frame members.

In some embodiments, the kit further comprises a set of plugs for closure of selected vacuum ports among the series of vacuum ports.

In some embodiments, the interior sidewalls of the vacuum ports are threaded and the plugs are threaded for corresponding installation into the vacuum ports.

In some embodiments, the kit further comprises instructions for assembly of a screened vacuum enclosure with a commercially-obtained screen and either nine vacuum pipes or four vacuum pipes, wherein the assembly of the screened vacuum enclosure with nine vacuum pipes uses longitudinal inner frame members without channels and the screened vacuum enclosure with four vacuum pipes uses longitudinal inner frame members with channels.

In some embodiments, the kit further comprises an adhesive for fixing the covering floor structure to one side of the frame and for fixing a screen to the other side of the frame.

BRIEF DESCRIPTION OF THE DRAWINGS

Various objects, features and advantages of the invention will be apparent from the following description of particular embodiments of the invention, as illustrated in the accompanying drawings. The drawings are not necessarily to scale, emphasis instead being placed upon illustrating the principles of various embodiments of the invention. Similar reference numerals indicate similar components.

DETAILED DESCRIPTION OF THE INVENTION

Rationale

Figure 1:
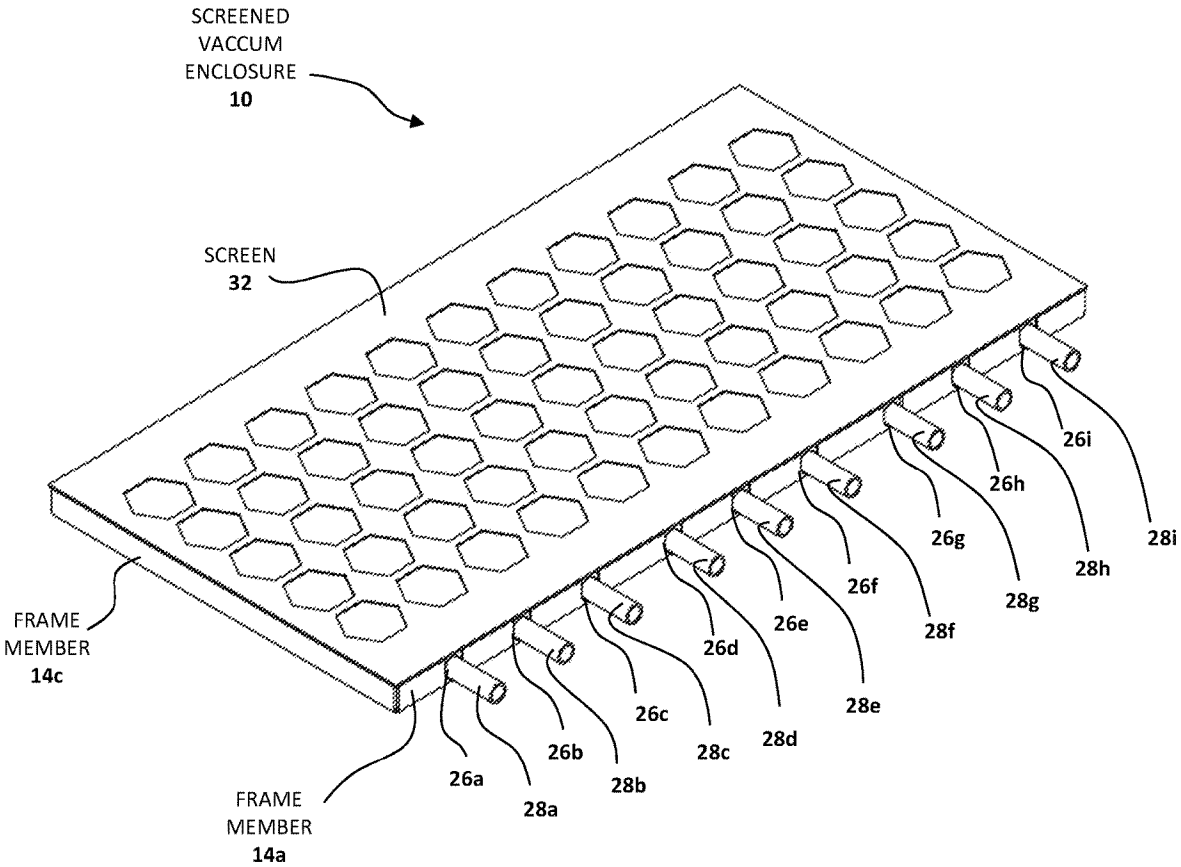
FIG. 1 is a top perspective view of one embodiment of the screened vacuum enclosure 10 with nine vacuum pipes 28*a*-28*i* installed in nine vacuum ports 26*a*-26*i*.

Existing vacuum screen fluid recovery systems, such as the systems described in U.S. Patent Publication Nos. 2014/0091028, 2013/0092637, 2013/0074360, 2012/0279932 and 2011/0284481 (each incorporated herein by reference in entirety), use a vacuum device attached to the underside of the frame of a screen on a shaker (see for example, FIG. 1E of U.S Patent Publication No. 2013/0074360, which is attached to about one third of the underside of the screen frame). This vacuum system operates by suction of the drilling fluid from the drill cuttings as they vibrate on a downstream shaker screen after having vibrated without vacuum suction across one or more upstream shaker screens. The recovered drilling fluid is then conveyed under vacuum pressure to a storage tank and then circulated to mud tanks for re-use.

While this system represents a valuable advancement in the art which has met with significant commercial success, improvements continue to be sought after in efforts to address certain disadvantages. For example, the existing vacuum attachment arrangement adds weight disproportionately to one portion of the downstream screen and interferes with the manufacturers intended harmonics profile for the screen during the shaking process, thereby impacting the efficiency of separation. Commercially available shakers, screens and screen frames are not designed to handle such asymmetric stress. It would be advantageous to provide alternatives that address these issues as well as providing additional advantages. Such advantages are provided by various embodiments of the present invention.

Introduction and Overview

The present invention has been made to address a number of shortcomings of existing vacuum-based liquid recovery systems. One such example is the issue of the extra weight placed on the screen by an external vacuum attachment connected to the underside of the screen as noted above. Therefore, the present invention allows the external vacuum manifold attachment and screen system to be replaced with a structure formed from a rectangular frame to which is fixed a top screen and an opposing floor. The rectangular frame is configured for installation of a series of vacuum pipes or adapters which may adopt various configurations and which are provided for connection to a vacuum system. This inventive structure is herein designated the "screened vacuum enclosure."

One of the long sides of the frame (a longitudinal frame member) of the screened vacuum enclosure is provided with a series of vacuum ports for provision of vacuum suction extending from the screen surface, down into the interior of the structure and the outward via the vacuum ports to the vacuum source. Advantageously, all connections of the parts of the device are sealed to preserve vacuum flow of air down from the screen and outward to the vacuum source. As such, the entire interior of the structure which is bounded by the outer frame members, the top screen and the floor, or a portion thereof, can be subjected to vacuum suction in a manner similar to the vacuum suction provided by the vacuum manifold structure of the vacuum systems described in U.S. Patent Publication Nos. 2014/0091028, 2013/0092637, 2013/0074360, 2012/0279932 and 2011/0284481 (each incorporated herein by reference in entirety). The screened vacuum enclosure is more compact and lighter than the state-of-the-art vacuum screen system currently in use. It is expected that significant mitigation of the mechanical stress-related problems caused by direct connection of large vacuum attachments to the underside of the screen will be confirmed.

In certain embodiments, the weight of the screened enclosure is substantially similar to as that of a framed screen unit itself, as supplied by manufacturers. Furthermore, replacement of the external vacuum attachment system with the screened vacuum enclosure is expected to provide more space near the downstream end of the shaker. Certain embodiments of the screened enclosure are customizable by adding or removing vacuum conduit pipes to and from the frame as described hereinbelow. Thus the system can be adapted to provide optimal vacuum pressure for removal of various types of drilling fluids from various consistencies of drill cuttings.

Definitions

As used herein, the term "screened vacuum enclosure" is a general term which encompasses all embodiments of the present invention which include a support frame with vacuum ports, a top screen and a bottom floor, as well as any pipes, adapters and/or plugs which may be connected to the vacuum ports.

As used herein, the term "frame" refers to a three dimensional support structure in the sense of a building frame rather than a two-dimensional surrounding support structure in the sense of a picture frame, and is used in context of describing a support structure for the screened vacuum enclosure.

As used herein, the terms "shaker" and the alternative art-accepted term "shale shaker" are synonymous and refer to an apparatus designed to support and vibrate screen frames in a process for recovering drilling fluid from drill cuttings. Used drilling fluid flows directly to the shale shakers for processing. Once processed by the shale shakers, the drilling fluid is deposited into containers known as "mud tanks."

As used herein, the terms "screen basket" and "screen bed" are synonymous and refer to a platform on the shaker which is responsible for transferring the shaking intensity of the machine to the screen frames as they are held securely in place. It is to be understood that all embodiments of the screened vacuum enclosure are dimensioned for placement on screen beds. Different shakers produced by different manufacturers may have screen beds with different dimensions, therefore requiring screen frames and/or screened vacuum enclosures with different dimensions.

As used herein, the term "drilling fluid" is synonymous with the term "mud" used in the art of drilling for hydrocarbons. Drilling fluids are integral to the drilling process and, in addition to providing other functions, serve to lubricate and cool the drill bit as well as convey the drilled cuttings away from the bore hole. These fluids are composed of a mixture of various chemicals in water or oil based solutions and can be very expensive. For both environmental reasons and to reduce the cost of drilling operations, drilling fluid losses are minimized by removing them from the drilled cuttings before the cuttings are disposed of.

As used herein, the term "drill cuttings" refers to any material conveyed upwards to the surface by the drilling process as a result of a drilling operation and may include soil, mud, and pieces/particles of various classes of rocks. When drill cuttings emerge from a drilling operation, they are typically covered with drilling fluid.

As used herein, the term "conduit" is used to describe any means for transmission of a vacuum pressure and/or liquids. Examples include, but are not limited to tubes, pipes or hoses of various compatible diameters which may be coupled to conveyance means driven by various types of liquid pumps or vacuum sources for conveyance of liquids.

As used herein, the terms "downstream" and "upstream" are relative terms used to identify locations in a process with respect to one or more other locations. A downstream location with respect to another location is a position closer to the end of the process than the other location. An upstream location with respect to another location is a position closer to the beginning of the process than the other location. These terms are in common usage in the arts relating to process engineering and are well understood by those skilled in the art.

As used herein, the terms "longitudinal" and "transverse" are used to distinguish between different frame members and specific interior areas of the screened vacuum enclosure. Longitudinal members and areas are greater in length than transverse members and areas.

As used herein, the term "screen" refers to any screen or mesh structure appropriate for separation of drilling fluid from drill cuttings on a shaker bed.

As used herein, the term "vacuum distributor" refers to an enclosed structure for distributing vacuum pressure or suction from a vacuum source to a plurality of vacuum lines extending to the screened vacuum enclosure of the present invention. The vacuum distributor may have any structure compatible with the function of splitting vacuum pressure to a plurality of vacuum lines extending to a screened vacuum enclosure.

Various aspects of the invention will now be described with reference to the figures. For the purposes of illustration, components depicted in the figures are not necessarily drawn to scale. Instead, emphasis is placed on highlighting the various contributions of the components to the functionality of various aspects of the invention. A number of possible alternative features are introduced during the course of this description. It is to be understood that, according to the knowledge and judgment of persons skilled in the art, such alternative features may be substituted in various combinations to arrive at different embodiments of the present invention. For example, the ensuing description illustrates embodiments that include screened vacuum enclosures configured for connection of the vacuum ports to various numbers of vacuum conduits in specific arrangements. Other arrangements with more than nine vacuum conduits as well as more or less than six or four vacuum conduits are possible and may be assembled by making routine modifications to the basic structure of the screened vacuum enclosure, or by simply connecting more or fewer vacuum conduits to alternative vacuum ports. Modifications required to arrive at such alternative embodiments can be effected by the skilled person without undue experimentation and are within the scope of the invention as defined by the claims.

Any terms which have not been explicitly defined herein, are to be considered as having meanings as they would be understood by persons skilled in the art. Such terms may also be reasonably inferable from the drawings and description and the combination thereof with the knowledge of the skilled person.

Embodiment 1: Screened Vacuum Enclosure Using Nine Vacuum Ports

Figure 2:
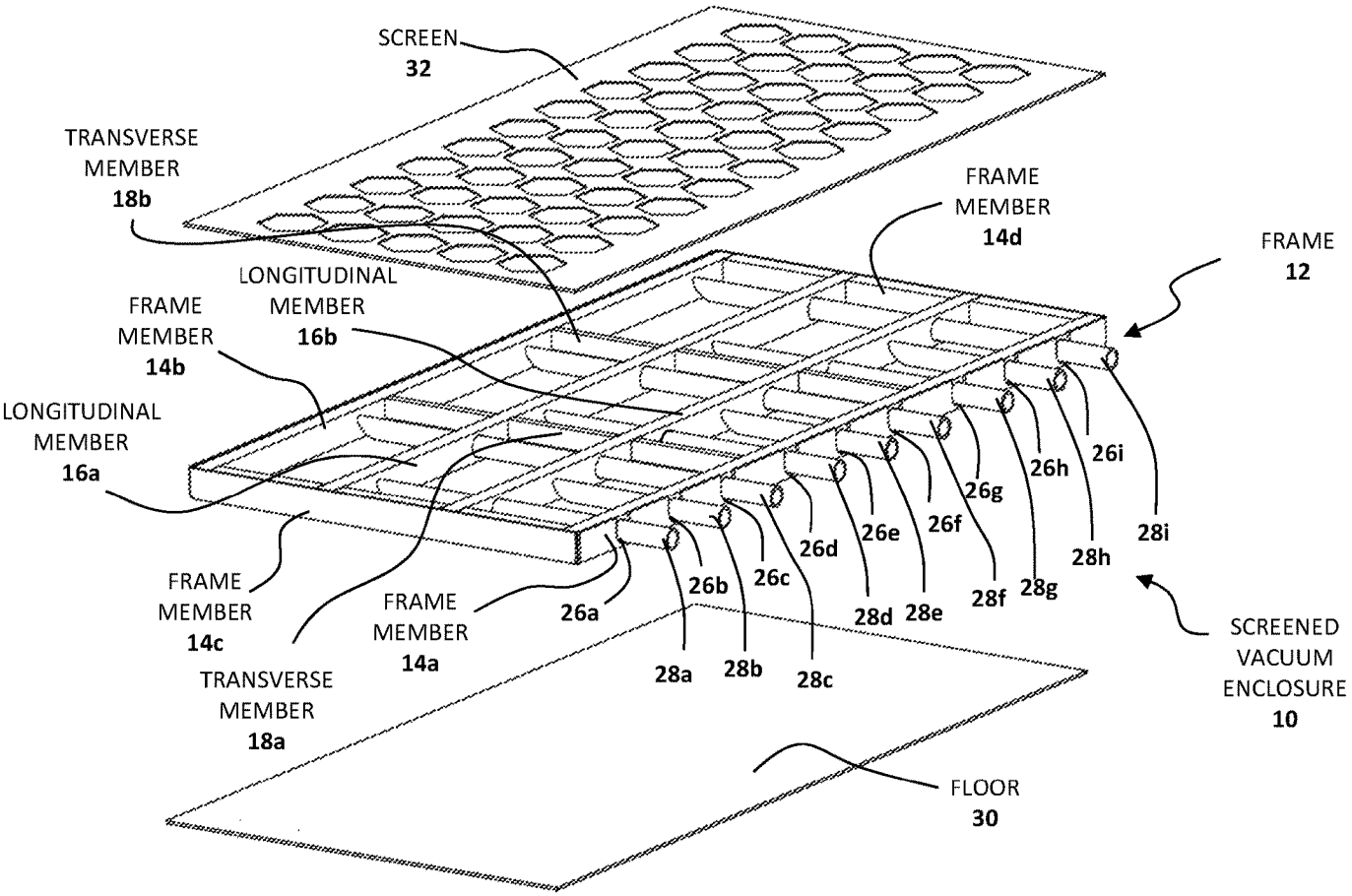
FIG. 2 is an exploded top perspective view of the same embodiment shown in FIG. 1.
Figure 3:
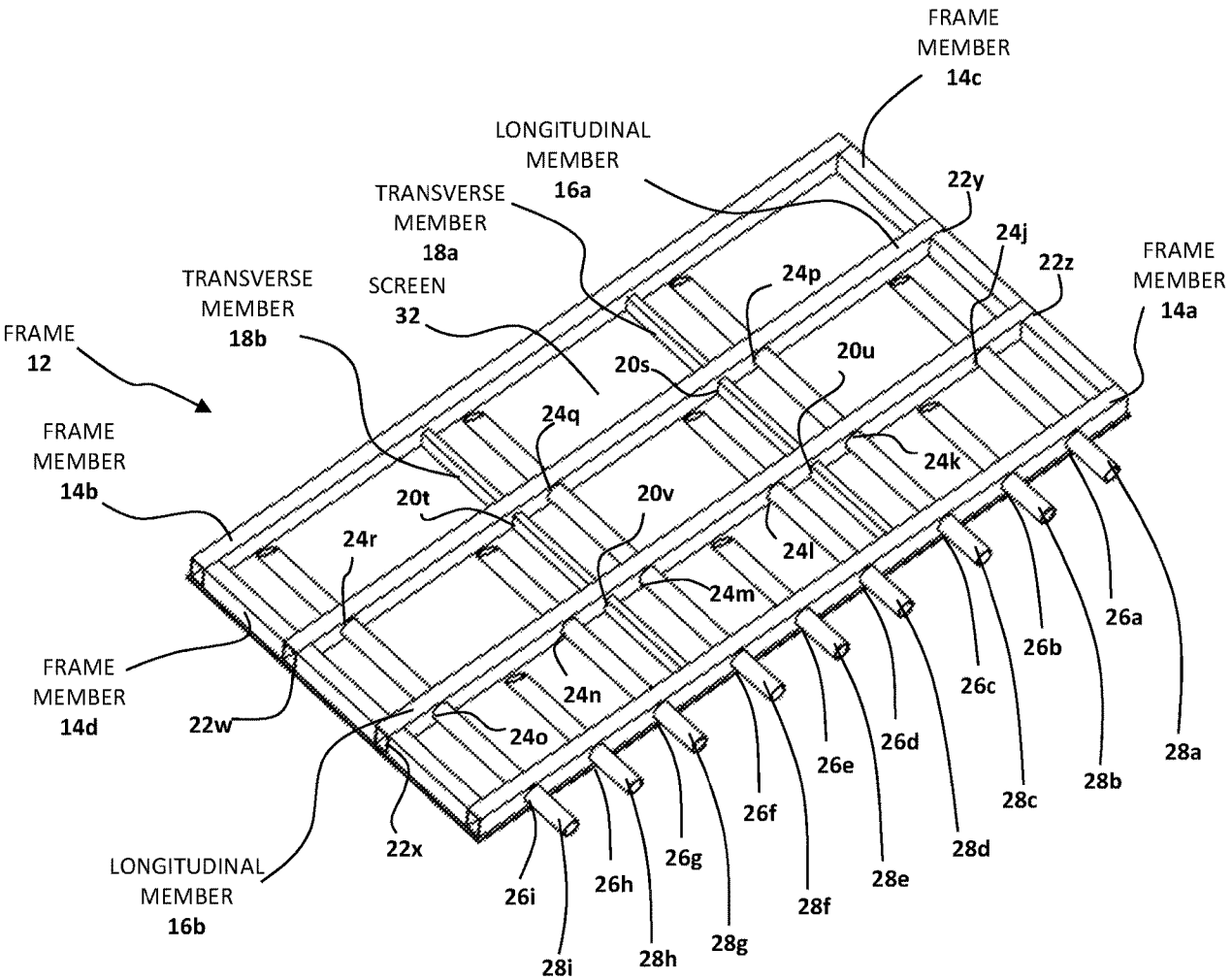
FIG. 3 is a bottom perspective view of the frame 12 and vacuum pipes 28*a*-28*i* installed in nine vacuum ports 26*a*-26*i* in same embodiment shown in FIGS. 1 and 2, with the floor component 30 removed.

With reference to FIGS. 1 to 3, there is shown a first embodiment of a screened vacuum enclosure 10. FIG. 1 is a perspective view of the assembled structure and FIG. 2 is an exploded view showing all major components of the structure. FIG. 3 is a view from the bottom of the structure with the bottom floor cover removed, showing more detail relating to inner support members.

Referring now to FIGS. 1 and 2, it can be seen that the screened vacuum enclosure 10 includes a frame 12 formed of outer frame members 14*a*, 14*b*, 14*c* and 14*d*. The longitudinal outer frame members are opposing members 14*a* and 14*b* and the transverse outer frame members are opposing members 14*c* and 14*d*. The interior of the frame 12 has two interior longitudinal support members 16*a* and 16*b* as well as two interior transverse support members 18*a* and 18*b*. In this particular embodiment, outer longitudinal frame member 14*a* has a series of nine vacuum ports 26*a* to 26*i*. Vacuum pipes 28*a* to 28*i* extend from each one of the vacuum ports 26*a* to 26*i*. Alternative embodiments may include fewer or additional interior support members.

The structure of the screened vacuum enclosure 10 includes a top screen 32 which may be any type of screen known in the art and used for separating drill cuttings from drilling fluids. Such screens are well known to those skilled in the art. The screen is attached to the top surfaces of the frame 12 in certain embodiments may also be at least partially supported by the upper surfaces of the interior support members 16*a*, 16*b*, 18*a* and 18*b*. The screened vacuum enclosure 10 also includes a floor 30 attached to the bottom surfaces of the frame 12. An appropriate manner of attaching the screen 32 and floor 30 to the top and bottom surfaces of the frame 12 may be readily developed by one with ordinary skill in the art and may include the use of an adhesive such as an epoxy resin or cement, or other equivalent attachment means. Advantageously, the attachments provide a sealing arrangement such as a fitted gasket, for example, which prevents loss of vacuum pressure when the screened vacuum enclosure is in operation. Such attachment and sealing features are compatible with all embodiments of the invention and can be produced by the skilled person without undue experimentation.

More detail regarding the interior connections between the frame members 14*a*-14*d*, the interior support members 16*a*, 16*b*, 18*a* and 18*b* and the vacuum pipes 28*a*-28*i* will now be described with reference to FIG. 3, which shows a perspective view from the bottom with the floor 30 removed. It is to be noted that this view would be obtained by a 180 degree rotation around the central transverse axis of the orientation of the frame 12 shown in the exploded view of the device shown in FIG. 2.

As noted above, this particular embodiment of the screened frame enclosure 10 includes a rectangular frame structure 12 formed of four exterior frame members 14*a*, 14*b*, 14*c* and 14*d* in a rectangular shape. There are two longitudinal support members 16*a* and 16*b* and two transverse support members 18*a* and 18*b*. In this particular embodiment, the longitudinal support members 16*a* and 16*b* are wider than the transverse support members 18*a* and 18*b* and this enables assembly of the frame 12 to be facilitated by providing rectangular shaped lateral openings 20*s*, 20*t* in longitudinal support member 16*b* and rectangular shaped lateral openings 20*u* and 20*v* in longitudinal support member 16*a*. The rectangular transverse support members 18*a* and 18*b* are dimensioned to extend through and seal each of these rectangular lateral openings 20*s*, 20*t*, 20*u* and 20*v* to fix the transverse support members 18*a* and 18*b* in place within the frame 12. Likewise, rectangular notches 22*w* and 22*x* are provided in frame member 14*d* and rectangular notches 22*y* and 22*z* are provided in frame member 14*c*. The ends of longitudinal members 16*a* and 16*b* fit into these rectangular notches 22*w*, 22*x*, 22*y*, and 22*z* to fix the longitudinal members 16*a* and 16*b* to the frame 12.

In this particular embodiment, each of the longitudinal support members 16*a* and 16*b* is provided with a series of round openings for passage of vacuum conduit pipes. The skilled person will recognize that alternative embodiments will employ vacuum conduit pipes with square or rectangular cross sections and that the openings in longitudinal support members 16*a* and 16*b* will also be square or rectangular to allow passage of square vacuum pipes.

In the present embodiment, longitudinal support member 16*b* is provided with six round openings 24*j*, 24*k*, 24*l*, 24*m*, 24*n* and 24*o*. In a similar manner, longitudinal support member 16*a* is provided with three round openings 24*p*, 24*q* and 24*r*. Each of these nine openings 24*j*-24*r* is aligned with a corresponding port from among the nine vacuum ports 26*a*-26*i* in outer frame member 14*a* to allow passage of one of the vacuum pipes 28*a*-28*i*. Therefore, vacuum pipe 28*a* is of intermediate length and extends through opening 24*j* in longitudinal member 16*b*, terminating in the middle section of the rightmost transverse interior area; vacuum pipe 28*b* is a short pipe which terminates before reaching longitudinal member 16*b*, terminating in the right section of the rightmost transverse interior area; and vacuum pipe 28*c* is a long pipe which extends through opening 24*k* in longitudinal member 16*b* as well as opening 24*p* in longitudinal member 16*a*, terminating in the left section of the rightmost transverse interior area.

The arrangement of pipes 28*a* to 28*c* with respect to the frame 12 and the inner support members 16*a*, 16*b*, 18*a* and 18*b* has just been described for the three rightmost inner rectangles of the grid in FIG. 3. It can also be seen that the same pattern is used for the middle and leftmost inner rectangles. It can be seen that the longitudinal members 16*a* and 16*b* and transverse members 18*a* and 18*b* create a nine-section grid with nine inner rectangular sections. It is also helpful to consider the nine rectangle grid as also having three defined transverse areas (each containing three rectangles) and three defined longitudinal areas (each containing three rectangles). For greater clarity, the leftmost longitudinal area contains the inner ends of long pipes 28*c*, 28*f* and 28*i*; the middle longitudinal area contains the inner ends of intermediate pipes 28*a*, 28*d* and 28*g*; and the rightmost longitudinal area contains the inner ends of short pipes 28*b*, 28*e* and 28*h*. Likewise, the rightmost transverse area contains the inner ends of pipes 28*a*, 28*b* and 28*c*; the middle transverse area contains the inner ends of pipes 28*d*, 28*e* and 28*f*; and the leftmost transverse area contains the inner ends of pipes 28*g*, 28*h* and 28*i*.

Figure 7:
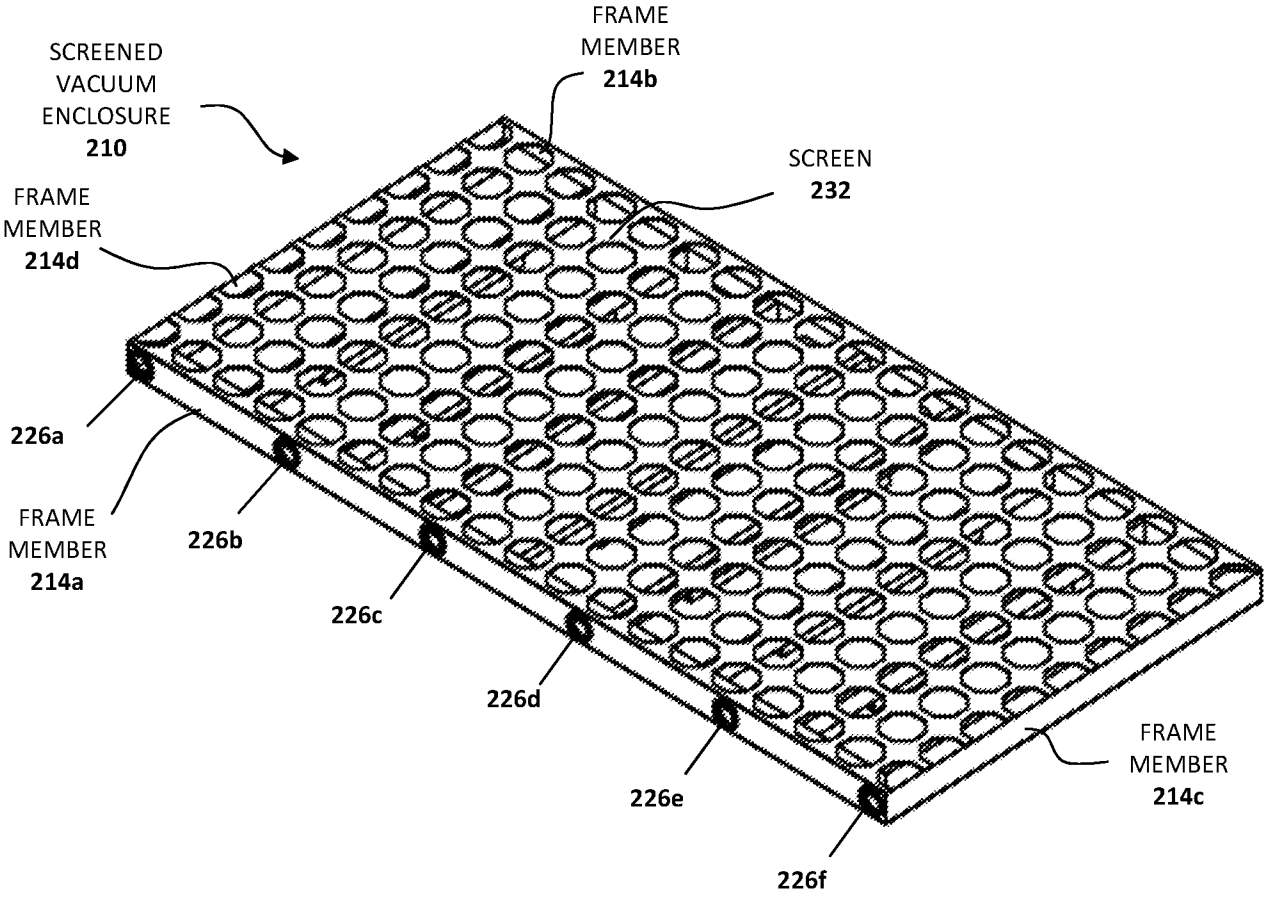
FIG. 7 is a perspective view of a third embodiment of the screened vacuum enclosure 210 with vacuum ports 226*a*-*f* in frame member 214*a* which extend into a continuous hollow space within the outer frame portion defined by frame members 214*a*-*d*.
Figure 8:
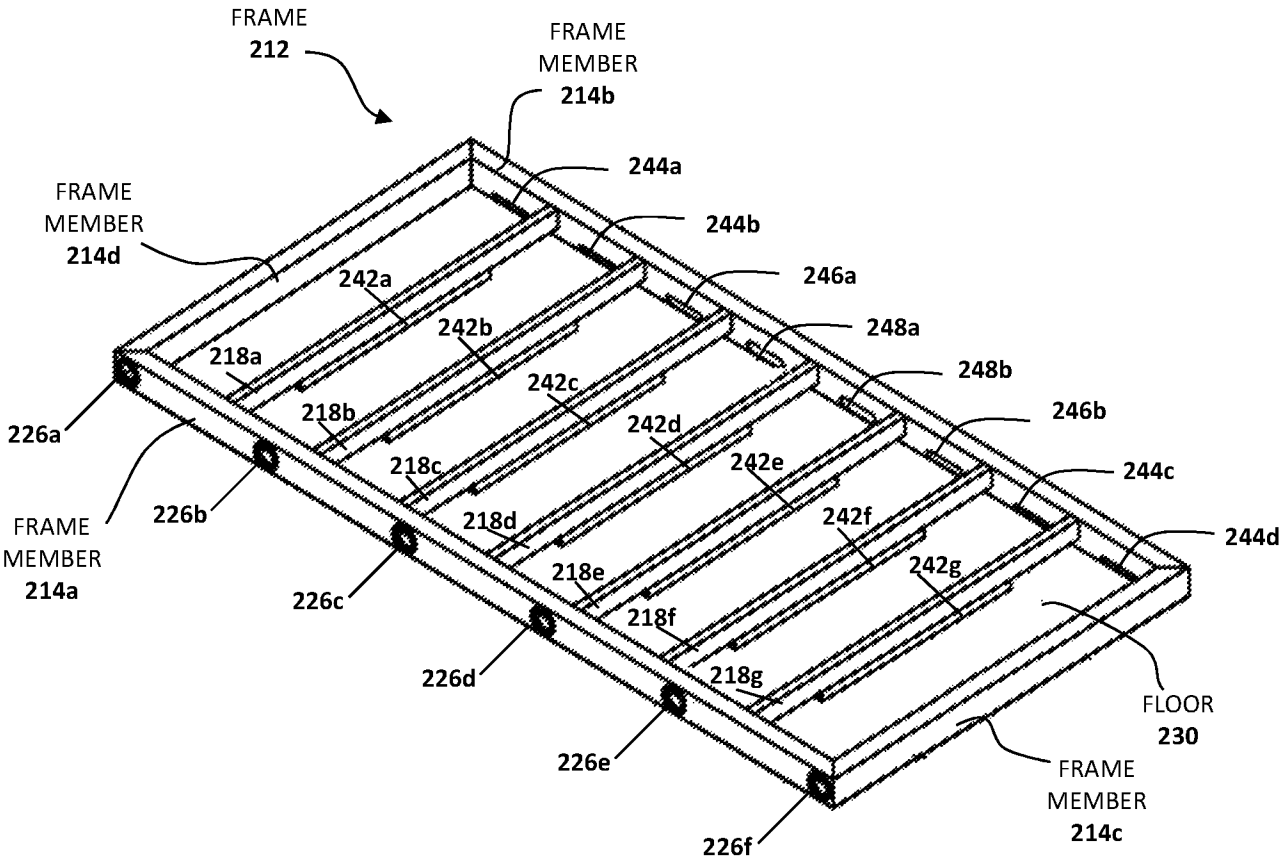
FIG. 8 is a perspective view of the embodiment 210 of FIG. 7 with the screen removed and showing a series of slots 244*a*-*d*, 246*a*-*b*, and 248*a*-*b* in frame member 214*b* which join the hollow space of the outer frame. Also shown are transverse support members 218*a*-*g* and corresponding spacer elements 242*a*-*g*.

The outer ends of the pipes 28*a*-28*i* are each configured for attachment to a corresponding vacuum conduit line which extends to a central vacuum distribution unit (shown in FIGS. 7A and 7B). The open inner ends of the vacuum pipes 28*a*-28*i* which are best seen in FIG. 3, are angled with their open faces pointing toward the floor 30 (removed in FIG. 3) of the screened vacuum enclosure 10. The present embodiment is configured to provide a vacuum pipe with an opening in each of the nine sections of the nine-section grid. The skilled person will recognize that the provision of a vacuum pipe opening in each section of the grid provides generally consistent vacuum coverage over substantially the entire area of the screen.

Figure 4:
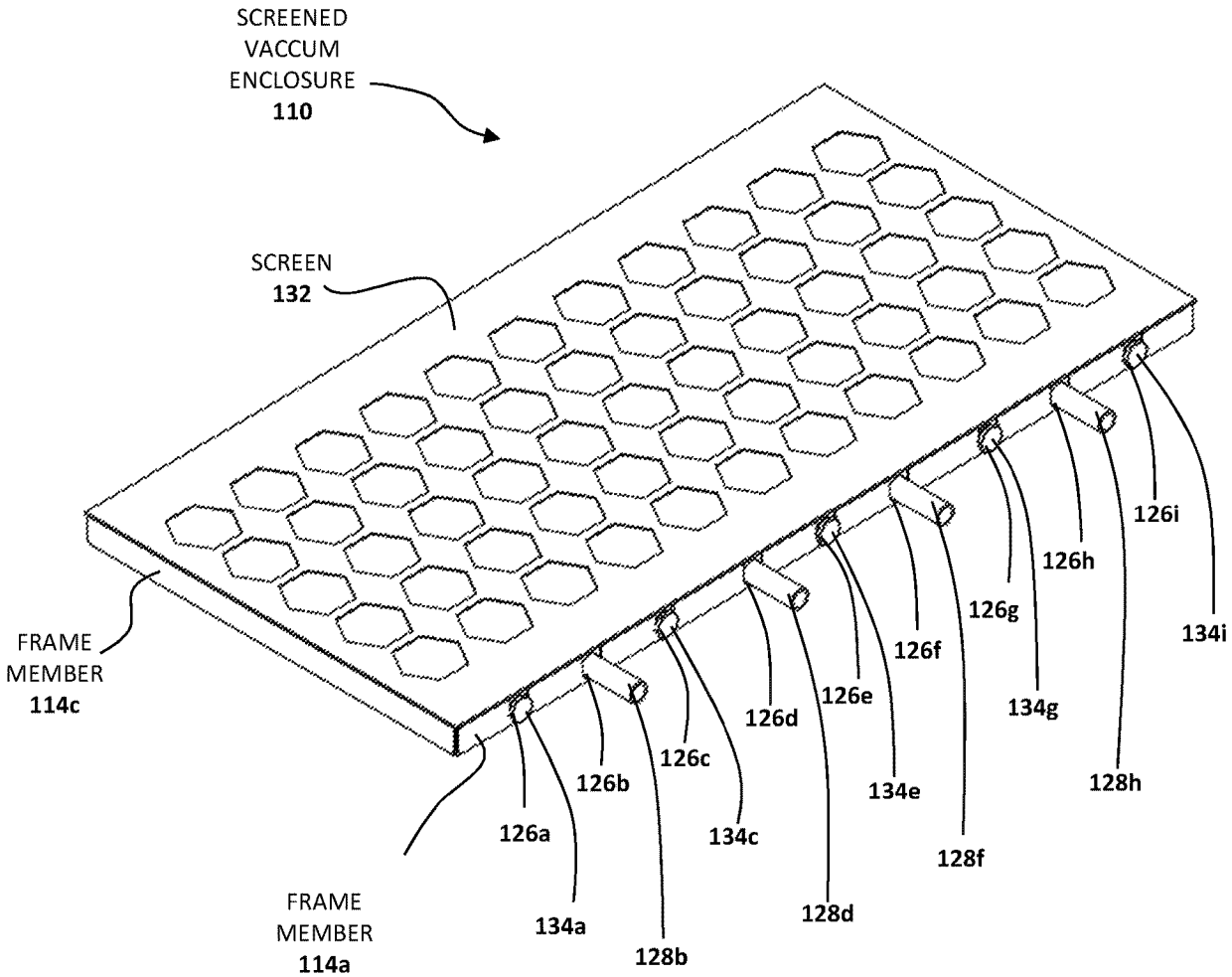
FIG. 4 is a top perspective view of a second embodiment of the screened enclosure 110 with four vacuum pipes 128*b*, 128*d*, 128*f* and 128*h* installed in four of the nine vacuum ports.

Embodiment 2: Screened Vacuum Enclosure Using Four of Nine Available Vacuum Ports Turning now to FIGS. 4 to 6, there is shown an alternative embodiment of the screened vacuum enclosure 110, wherein efforts are made to use similar reference numerals and labels to indicate similar features. This particular embodiment may be considered a modification of the first embodiment, or vice versa. It can be seen that the general structure of the screened vacuum enclosure is similar to that of the embodiment of FIGS. 1 to 3. There is a frame 112 formed of outer frame members 114*a*, 114*b*, 114*c* and 114*d* and interior frame members 116*a*, 116*b*, 118*a* and 118*b*. Likewise, there is an attached floor 130 and screen 132 and longitudinal outer frame member 114*a* is defined by the presence of nine vacuum ports 126*a*-126*i*. Also similar to the first embodiment are the rectangular openings 120*s*, 120*t*, 120*u* and 120*v* in the longitudinal inner members 116*a* and 116*b* to accommodate the transverse members 118*a* and 118*b* and the notches 122*w*, 122*x*, 122*y* and 122*z* in the outer frame transverse members 14*c* and 14*d* to accommodate the ends of the longitudinal inner frame members 116*a* and 116*b*. However, in the present embodiment, only four of the nine vacuum ports (ports 126*b*, 126*d*, 126*f* and 126*h*) are fitted with vacuum pipes 128*b*, 128*d*, 128*f* and 128*h*. The remaining vacuum ports 128*a*, 128*c*, 128*e*, 128*g* and 128*i* are sealed with corresponding plugs 134*a*, 134*c*, 134*e*, 134*g* and 134*i*. Advantageously, in both of the main embodiments described, the interior of each of the round vacuum port openings is threaded to facilitate convenient insertion of correspondingly threaded plugs. It is to be understood that other arrangements of various numbers of pipes may be provided and these alternative embodiments may provide relative alterations in vacuum pressure across the screen 132. These alternative embodiments are within the scope of the invention.

Figure 5:
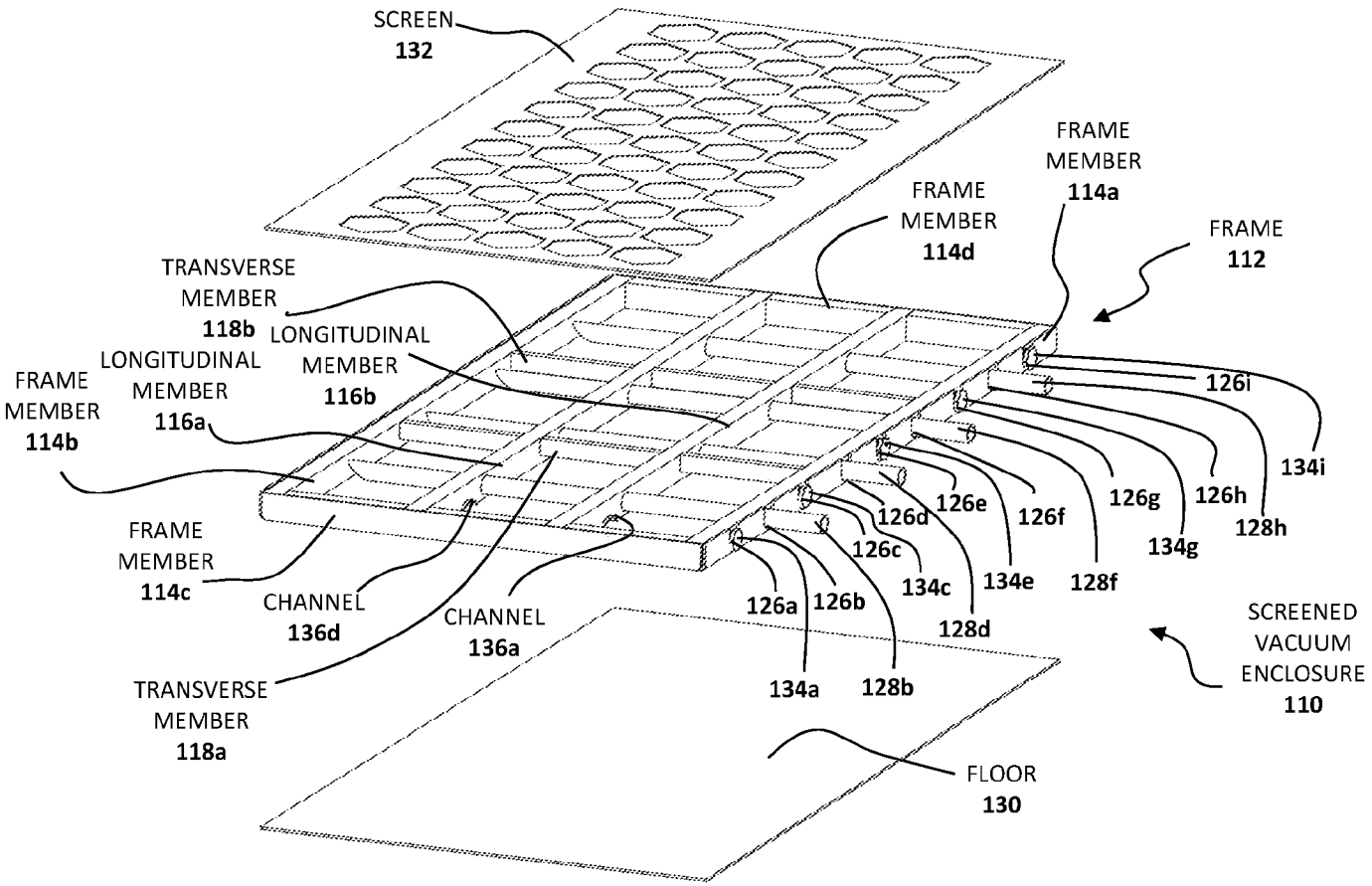
FIG. 5 is an exploded top perspective view of the same embodiment shown in FIG. 4.
Figure 6:
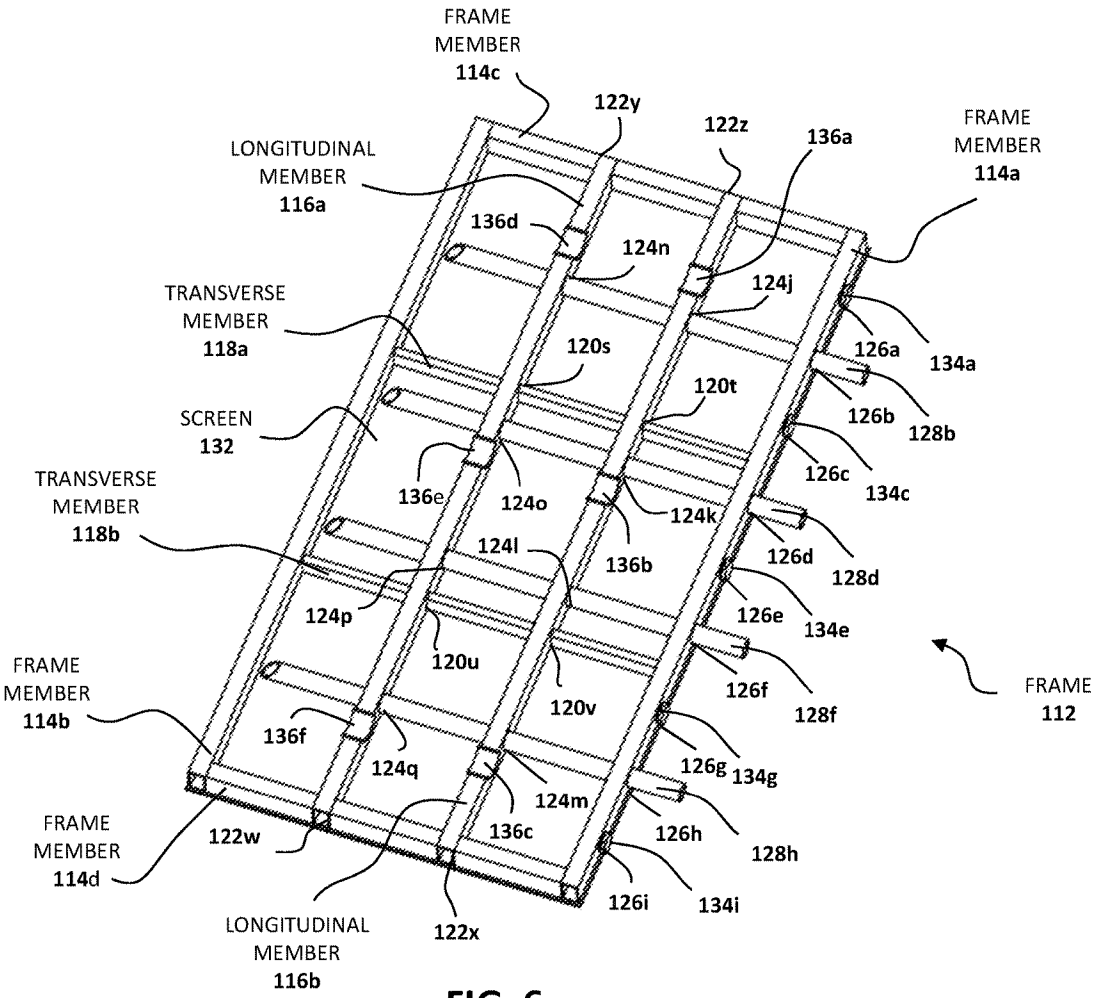
FIG. 6 is a bottom perspective view of the frame 112 and four vacuum pipes 128*b*, 128*d*, 128*f* and 128*h* in the same embodiment 110 shown in FIGS. 4 and 5, with the floor component 130 removed.

It is seen in the bottom perspective view of FIG. 6 (which is a view similar to that of FIG. 3 of Embodiment 1, and which is obtained by a 180 degree rotation at the central transverse axis of the orientation of the frame 112 shown in the exploded view of the device shown in FIG. 5), that the longitudinal support members 116*a* and 116*b* are each provided with four pipe openings. Therefore, longitudinal support member 116*b* has openings 124*j*, 124*k*, 124*l* and 124*m* and longitudinal support member 116*a* has openings 124*n*, 124*o*, 124*p* and 124*q*. The arrangement provided allows the four vacuum pipes 128*b*, 128*d*, 128*f* and 128*h* to extend across essentially the entire width of the frame such that their open inner ends are adjacent to the outer longitudinal frame member 114*b* which opposes outer longitudinal frame member 114*a*. In an alternative description, each one of the four pipe endings can be considered as residing in the leftmost longitudinal area. In addition, the end of pipe 128*b* can be considered as residing in the rightmost transverse area; the ends of pipes 128*d* and 128*f* reside in the middle transverse area and the end of pipe 128*h* resides in the leftmost transverse area.

The skilled person will recognize that the present arrangement of vacuum pipes 128*b*, 128*d*, 128*f* and 128*h*, which each terminate near frame member 114*b* would have the effect of providing the vacuum suction to only the leftmost rectangles of the grid (with reference to FIGS. 5 and 6). In certain cases, this may be desirable. However, the present embodiment is modified to allow vacuum suction to extend to all nine sections of the grid by provision of a series of channels in each of the longitudinal members 116*a* and 116*b*. Accordingly, longitudinal member 116*b* has channels 136*a*, 136*b* and 136*c* and longitudinal member 116*a* has channels 136*d*, 136*e* and 136*f*. As a result, for example, with reference to FIG. 6, fluid may be pulled off the screen in the lower rightmost grid section by vacuum suction transmitted through channels 136*c* and 136*f* and into pipe 128*h*. The skilled person will recognize that a similar pathway of vacuum suction will occur in other parts of the grid, which is made possible by the presence of the other pairs of channels 136*a*/136*d* for pipe 128*b* and 136*b*/136*e* for pipes 128*d* and 128*f*. It is to be noted that while only one pair of channels 136*a*/136*d* is visible in FIG. 5, all six channels are in fact present but obscured by the perspective position of the transverse members 118*a* and 118*b* in FIG. 5.

The skilled person will recognize that the two different arrangements for providing suction via vacuum pipes according to the two embodiments described hereinabove, will provide different relative vacuum pressures at different locations of the screens. This differential vacuum suction may be characterized without undue experimentation and applied advantageously to separation of drilling fluids from drill cuttings with different characteristics in order to achieve an optimal balance between recovery of optimal volumes of drilling fluid with minimal generation of undesired fine particles of drill cuttings.

Embodiment 3: Screened Vacuum Enclosure with a Hollow Outer Frame Body and Six Vacuum/Wash Ports Turning now to FIGS. 7 to 13, there is shown an alternative embodiment of the screened vacuum enclosure 210, wherein efforts are made to use similar reference numerals and labels to indicate similar features relative to the first and second embodiments described hereinabove. This embodiment of the screened vacuum enclosure 210 includes a frame 212 formed of hollow outer frame members 214*a*, 214*b*, 214*c* and 214*d* and interior transverse support frame members 210*a*, 218*b*, 218*c*, 218*d*, 218*e*, 218*f*, and 218*g* which rest upon corresponding central spacer elements 242*a*, 242*b*, 242*c*, 242*d*, 242*e*, 242*f* and 242*g*. This embodiment also has a bottom floor 230 and a top screen 232 as similarly described for the previous embodiments.

As described in the previous embodiments, a series of vacuum ports 226*a*, 226*b*, 226*c*, 226*d*, 226*e* and 226*f* are provided in the forward facing (downstream) frame member 214*a*. However, these vacuum ports do not extend through the opposite side of frame member 214*a* but instead join the hollow interior space within frame member 214*a*. As noted above, all of the outer frame members 214*a-d* are hollow. These members are arranged such that their individual hollow spaces meet each other at the corners of the frame 212 to form a continuous hollow space that functions as a vacuum conduit when vacuum pressure is applied at one or more of the vacuum ports. While it is not necessary for the transverse support members 218*a-g* to be hollow and to join the hollow interior space of the frame, the skilled person will recognize that such an embodiment can be constructed if an analysis of air flow under vacuum pressure through the structure indicates that such a structure will enhance the removal of fluid from drill cuttings vibrating on the screen. Such an analysis and an interpretation thereof may be performed by the skilled person without undue experimentation.

The vacuum ports 226*a-f* are provided with a means for connecting adapters or plugs, such as interior threading. Adapters and plugs are then provided with corresponding outer threading and will be described in more detail hereinbelow.

Frame member 214*b* which opposes the front frame member 214*a* is provided with a series of slots on its side facing the interior of the screened vacuum enclosure 210. In this particular embodiment, there is one slot in each of the interior sections of the enclosure defined by the transverse support members 218*a-g*. Other embodiments may include fewer or additional slots. In this particular embodiment, slots 244*a*, 244*b*, 244*c* and 244*d* have similar dimensions, slots 246*a* and 246*b* have similar dimensions and are wider than slots 244*a-d* while having essentially the same length, and slots 248*a* and 248*b* have similar dimensions and are wider than slots 244*a-d* and 246*a-b* while having essentially the same length. These features are seen most clearly in FIG. 9B. The functional characteristics of provision of slots with different sizes will be described in more detail hereinbelow.

Figure 9A:
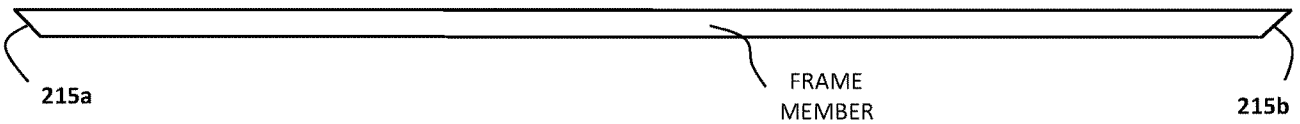
FIG. 9A is a top view of upstream frame member 214*b* showing mitered ends 215*a*-*b* which are configured to join corresponding mitered ends of outer frame members 214*c* and 214*d*.
Figure 9B:
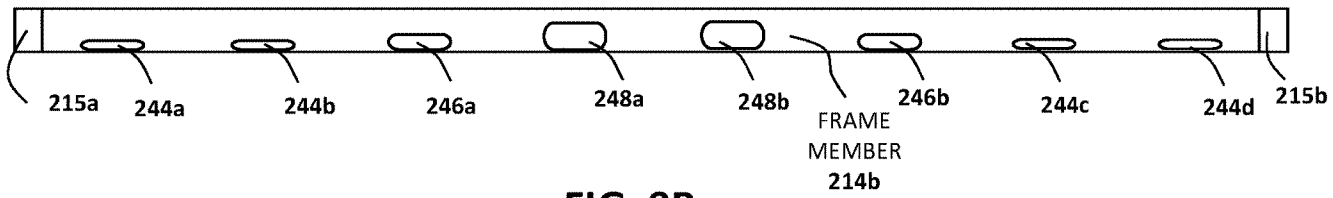
FIG. 9B is a side elevation view of the inner side of upstream frame member 214*b* showing slots 244*a*-*d*, 246*a*-*b*, and 248*a*-*b*.

Turning now to FIGS. 9A and 9B, there are shown top and side elevation views of frame member 214*b*, respectively. Both ends of frame member 214*b* are mitered to join the mitered ends of frame members 214*c* and 214*d*. Mitered ends of frame members 214*c* and 214*d* are not shown in FIGS. 9A and 9B, but can seen generally in FIGS. 8, 12 and 13. FIG. 9B shows the series of slots 244*a-d*, 246*a-b* and 248*a-b*. The skilled person will recognize that if all slots were the same size, a lesser volume of air would be drawn into the slots closer to the center of the frame member 214*a* than at the slots closer to the ends of the frame member 214*a*. Therefore, the reason for providing wider slots toward the center of frame member 214*b* is to provide a more even distribution of air flow into frame member 214*b* which translates to a more even distribution of vacuum pressure against the underside of the screen and by association, a more effective separation of drilling fluid from the drill cuttings. All of the slots 244*a-d*, 246*a-b* and 248*a-b* are provided with radiused corners to enhance the structural integrity of frame member 214*a*.

Figure 10A:
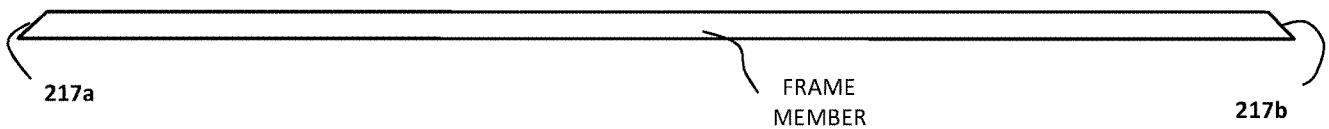
FIG. 10A is a top view of downstream frame member 214*a* showing mitered ends 217*a-b* which are configured to join corresponding mitered ends of outer frame members 214*c* and 214*d*.
Figure 10B:
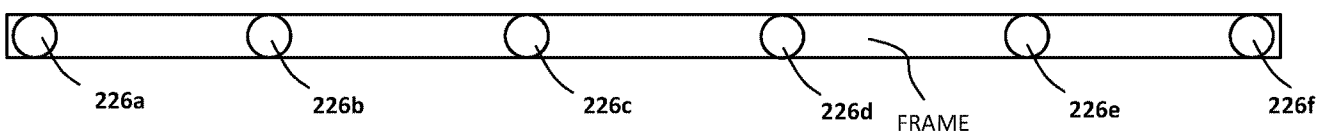
FIG. 10B is a side elevation view of the outer side of downstream frame member 214*a* showing vacuum ports 226*a-f*.

Turning now to FIGS. 10A and 10B, there are shown top and side elevation views of frame member 214*a*, respectively. As described above for frame member 214*b*, both ends of frame member 214*a* are mitered to join mitered ends of frame members 214*c* and 214*d* (not shown in FIGS. 10A and 10B). The side elevation view of FIG. 10B is of the outer side of frame member 214*a* showing the vacuum ports 226*a-f*. In this embodiment, all vacuum ports 226*a-f* are substantially identical circular openings. However, the skilled person will recognize that some variation is permissible. It is advantageous for the inner air flow characteristics however, that the total vacuum port area (the sum of the open areas of all vacuum ports 226*a-f*) be less than the total slot opening area (the sum of the open areas of all of the slots 244*a-d*, 246*a-b* and 248*a-b*) in order to have efficient air flow into and out of the screened vacuum enclosure 210.

Figure 11A:
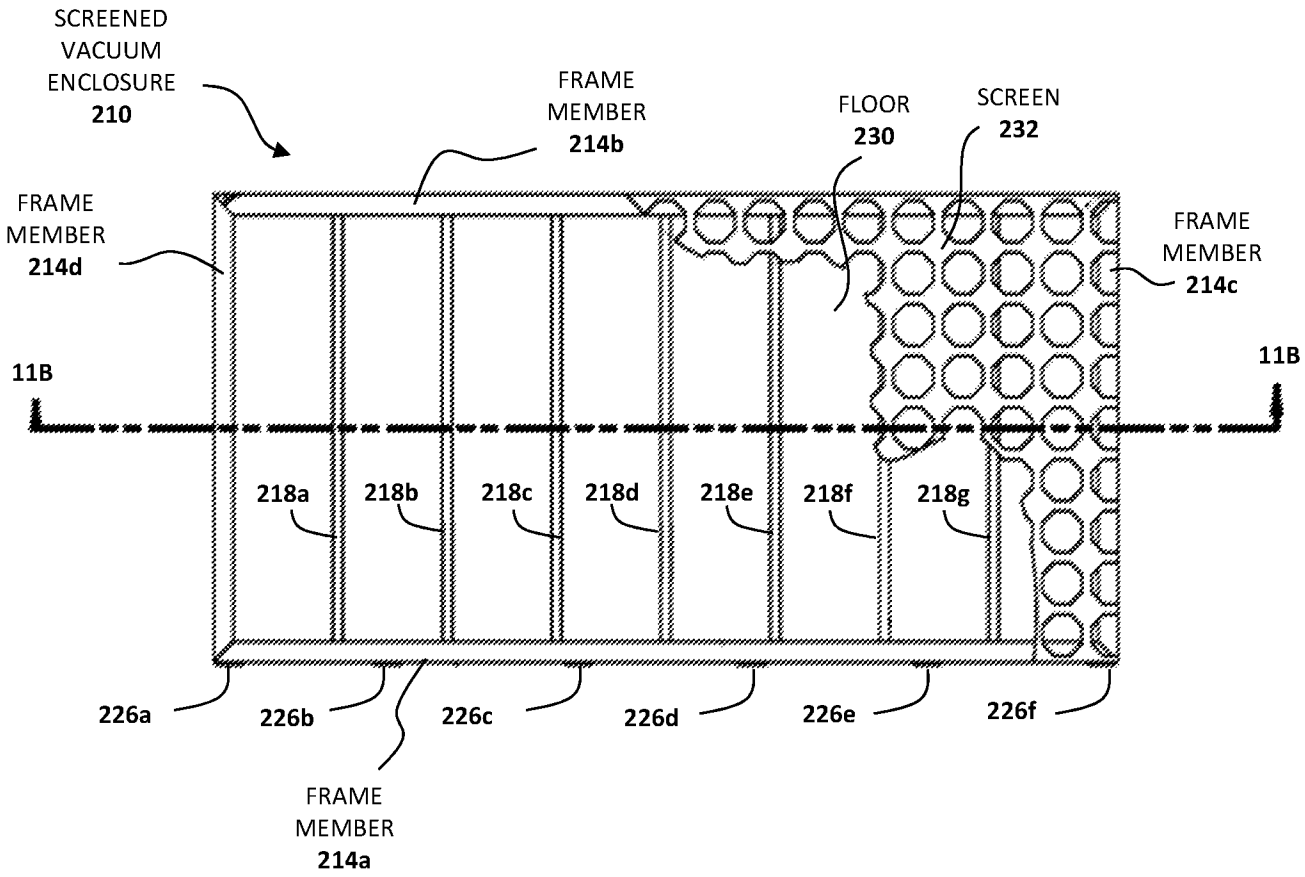
FIG. 11A is a plan view of the screened vacuum enclosure embodiment 210 with the screen 232 partially cut away and showing transverse inner frame support members 218*a-g*.
Figure 11B:
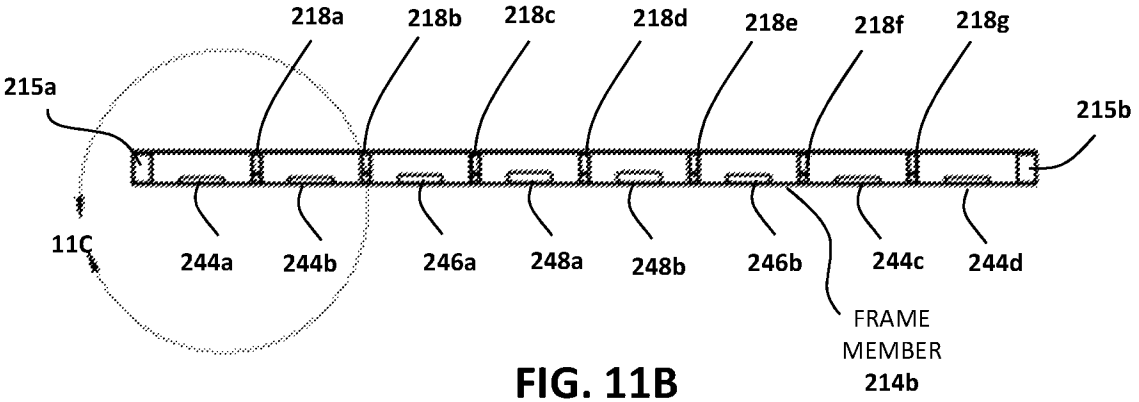
FIG. 11B is a cross sectional view taken along line 11B of FIG. 11A.
Figure 11C:
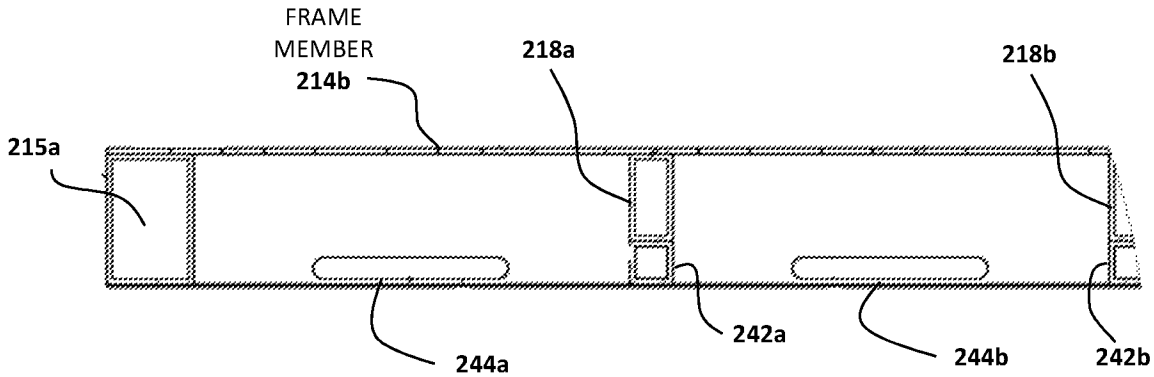
FIG. 11C is a magnified view of circle 11C in FIG. 11B, showing detail of slots 244*a-b*, as well as transverse members 218*a-b* and corresponding spacer elements 242*a-b*. Mitered end 215*a* is also shown.

FIG. 11A is a top plan view of the screened vacuum enclosure 210 with the screen 232 partially cut away. Previously described features are shown. FIG. 11B is a cross sectional view taken along line 11B of FIG. 11A. Because line 11B is at the center, it is seen that the spacer elements lie directly beneath the transverse support members, as seen more clearly for spacer elements 242*a* and 242*b* in the magnified view of FIG. 11C. Although not shown, the skilled person will understand that if a similar cross sectional line were to be taken closer to frame member 214*a* or 214*b*, the spacer elements would not be visible because they do not extend the entire length of the transverse support members. At these sections, there are open spaces that permit airflow between the transverse sections defined by the transverse support members 218*a-g* as described in more detail below.

Figure 12:
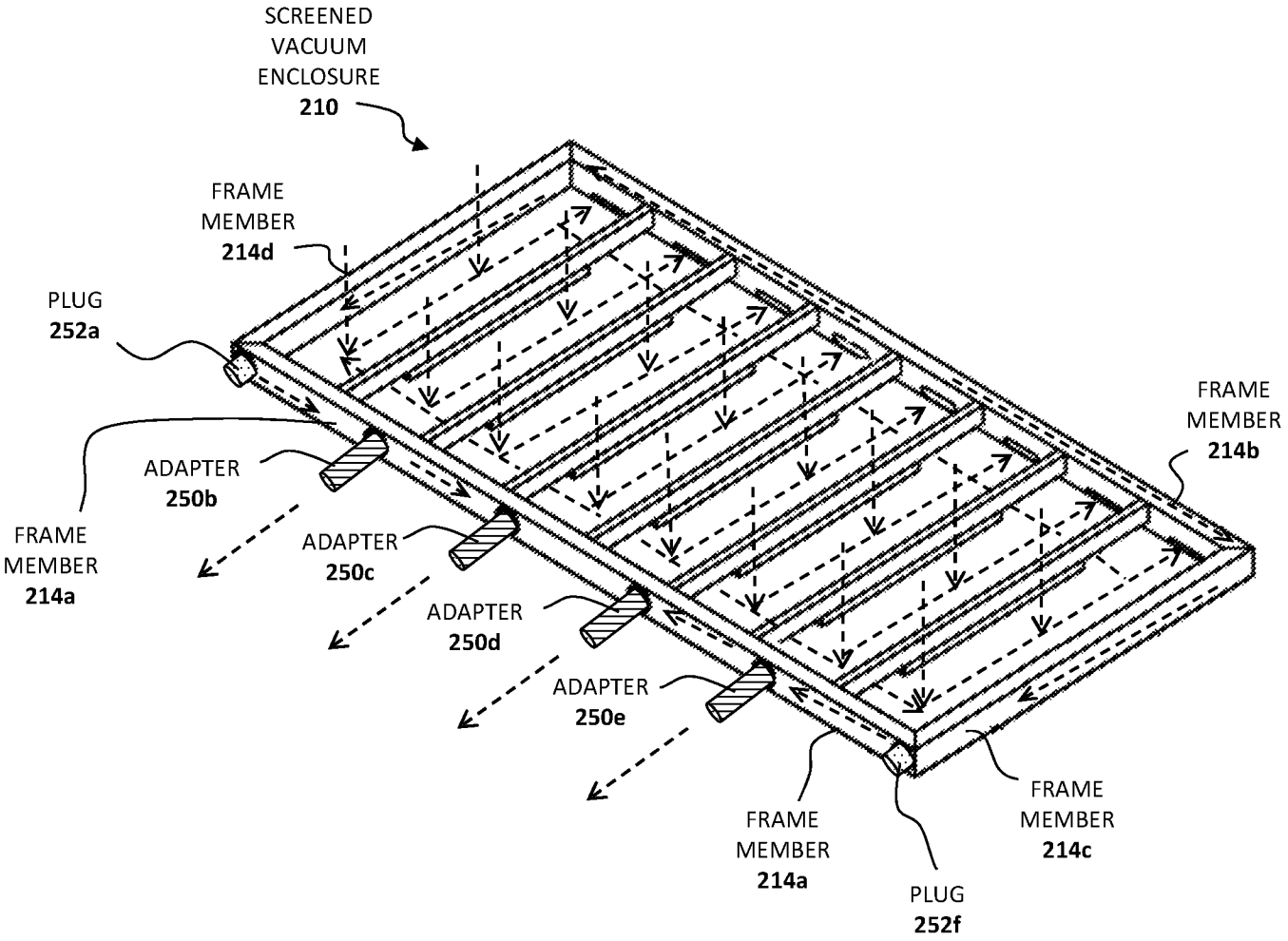
FIG. 12 is a perspective view of the screened vacuum enclosure embodiment 210 with the screen removed and showing hollow-body adapters 250*b-e* (for connection of vacuum lines) and plugs 252*a* and 252*f* connected thereto at the vacuum ports. The dashed lines indicate the general direction of vacuum air flow downward through the screen, through the spaces provided by spacer elements, into the slots, through the hollow body of the screened vacuum enclosure 210 and out of the screened vacuum enclosure 210 via the vacuum ports and adapters 250*b-e*.

Turning now to FIG. 12, there is shown a perspective view of the screened vacuum enclosure 210 with the screen removed and with hollow adapters 250*b-e* (for connection to a vacuum system) and plugs 252*a* and 252*f* connected to the vacuum ports 226*a-f* of the front frame member 214*a*. Dashed arrows indicate the general direction of airflow through the screened vacuum enclosure 210. While the ends of the arrows meet at right angles, the skilled person will recognize that this is a simplified representation made with the aim of preserving clarity. It is to be understood that under vacuum pressure applied at the adapters, air is drawn down from above the screen as indicated by the vertical arrows and then moves toward the slots in frame member 214*b*. Air moves through the spaces between the floor and the transverse frame members 218*a-g*. After entering the slots, the air flow moves within the continuous hollow space of the outer frame and out via the adapters 250*b-e*.

Figure 13:
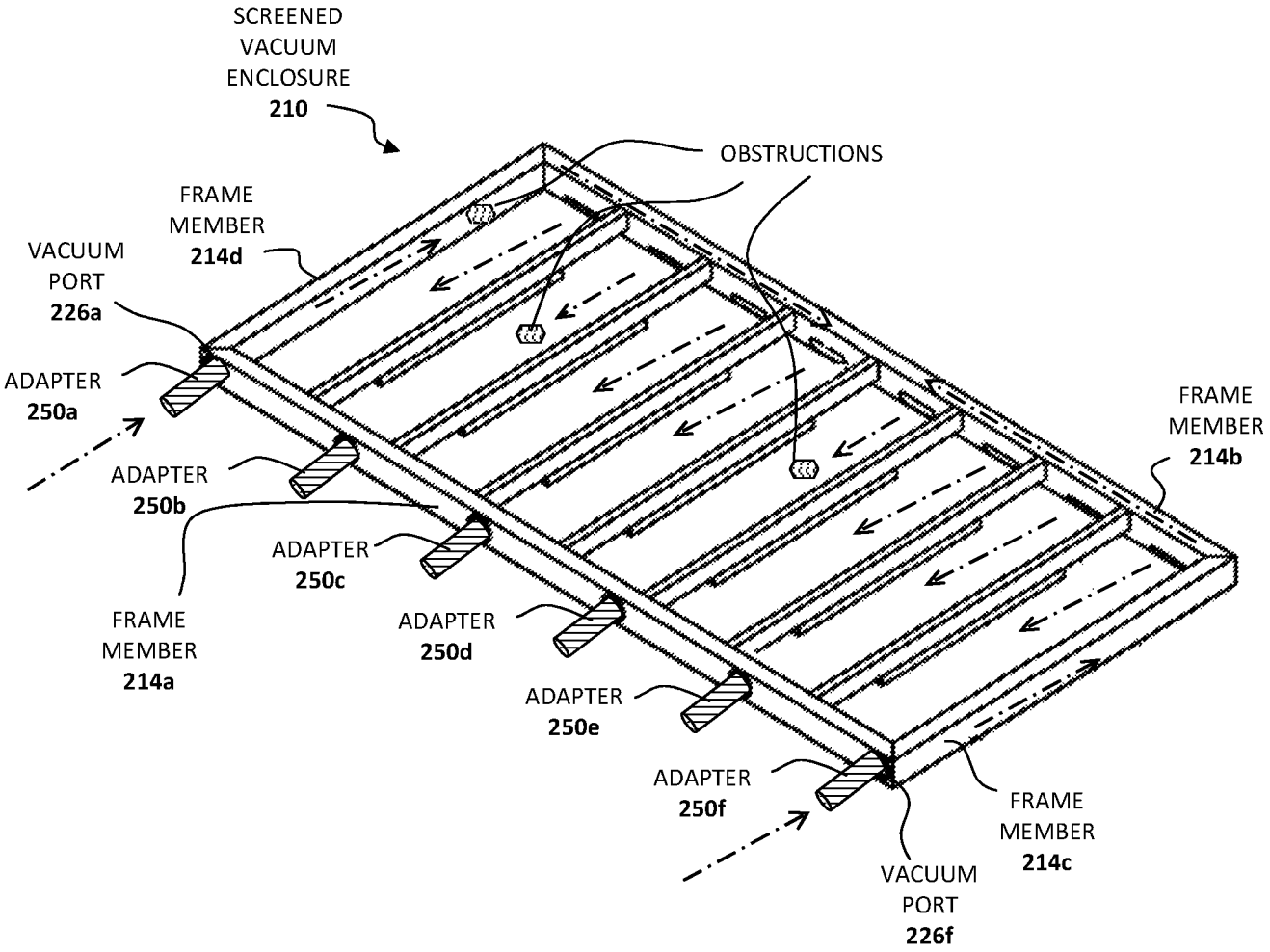
FIG. 13 is a perspective view of the screened vacuum enclosure embodiment 210 with the screen removed and showing hollow-body adapters 250*a-f* connected to the vacuum ports. The dot-dashed lines indicate the direction of movement of wash fluid into the hollow body of members 214*b* and 214*c* of the screened vacuum enclosure via adapters 250*a* and 250*f* for the purpose of removing obstructions within the hollow body of the screened vacuum enclosure 210.
Figure 14:
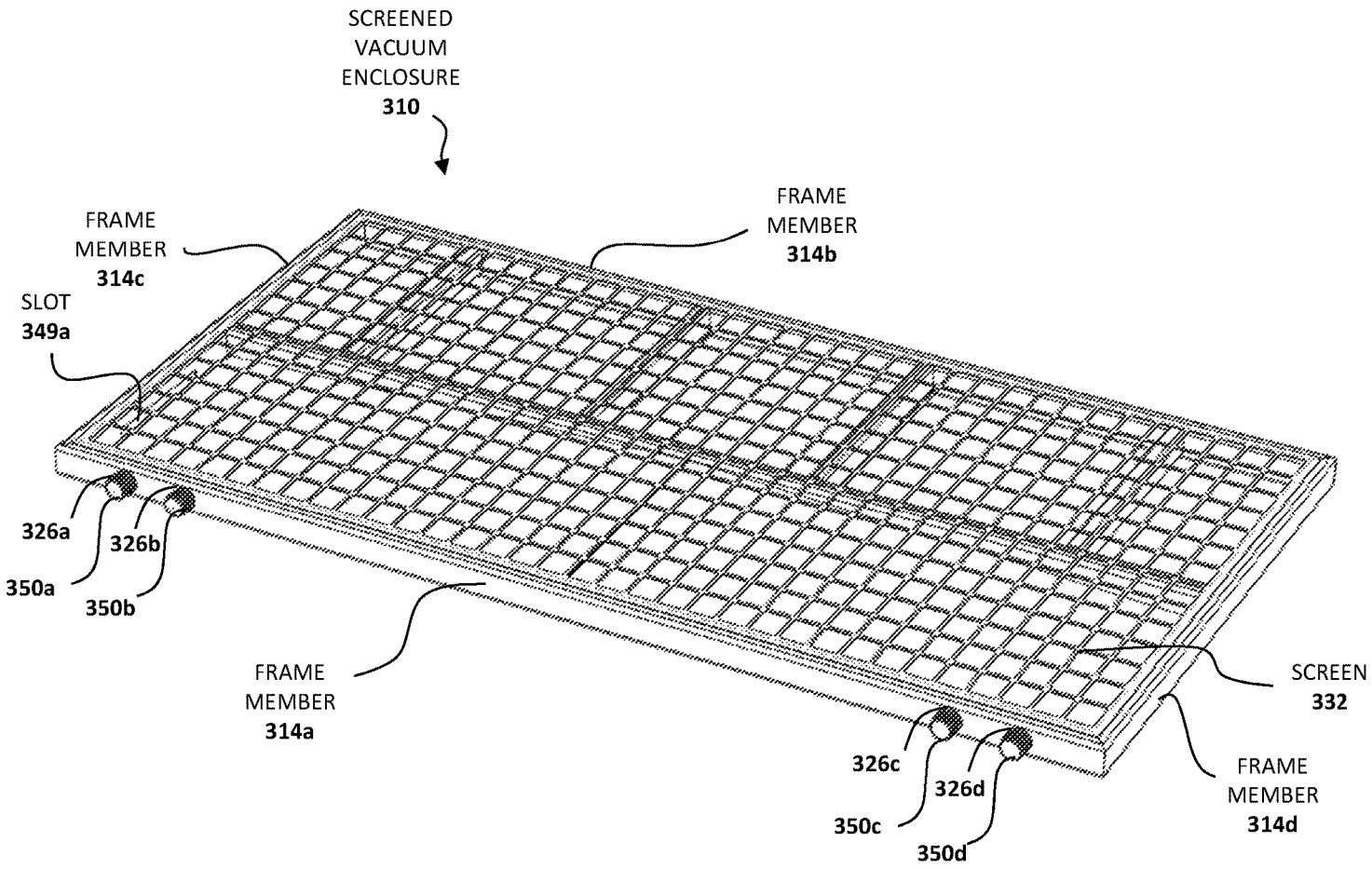
FIG. 14 is a top perspective view of a fourth embodiment of the screened vacuum enclosure 310 with vacuum ports 326*a-d* in frame member 314*a* which extend into a continuous hollow space within the outer frame portion defined by frame members 214*a* and at least about the front half of frame members 314*c* and 314*d*.
Figure 15:
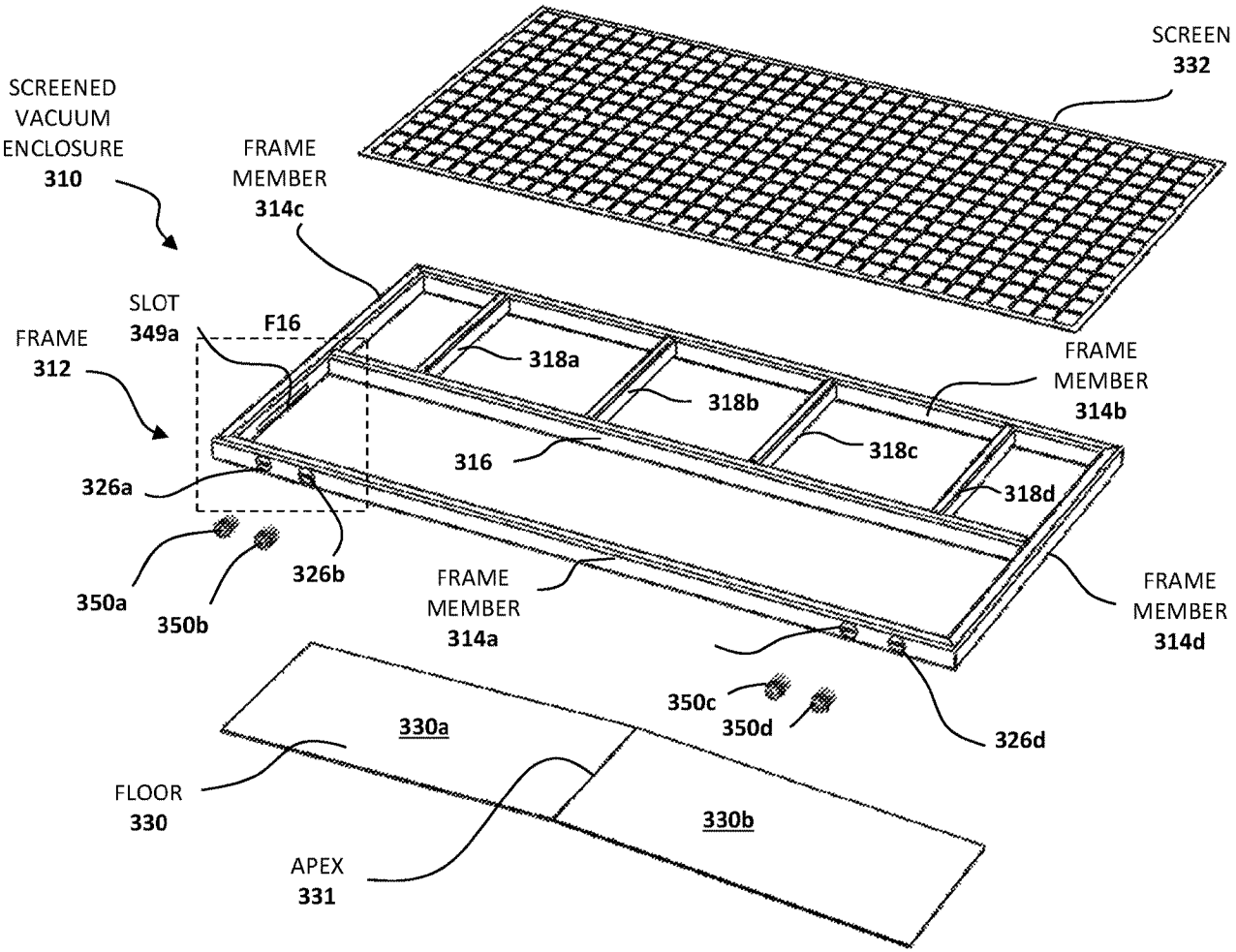
FIG. 15 is an exploded perspective view of the same embodiment of FIG. 14.

Shown in FIG. 13 is a perspective view of the screened vacuum enclosure 210 which illustrates additional functionality provided by this embodiment. In this view, the plugs 252*a* and 252*f* have been replaced with adapters 250*a* and 250*f* which provide a means for direct pumping of a wash fluid into the hollow spaces of frame members 214*d* and 214*c*. It is seen that the leftmost vacuum port 226*a* is aligned with the leftmost mitered end 217*a* (as pictured in FIG. 10A) and the rightmost vacuum port 226*b* is aligned with the rightmost mitered end 217*b* (as pictured in FIG. 10A). This arrangement allows the pumped wash fluid to enter the hollow space of the transverse frame members 214*d* and

214*c* directly and continue to frame member 214*b* where obstructions in the hollow space are then expelled through the slots.

The skilled person will recognize that this action may be performed simultaneously with vacuum pressure provided on the adapters 250*b-e* (as shown in FIG. 13A) or may be performed in an alternating fashion with washing first via adapters 250*a* and 250*f*, followed by vacuum suction at adapters 250*b-e*. The obstructive material would then ideally be broken up into smaller pieces by the force of pumping of the wash fluid and vacuumed out of the screened vacuum enclosure via the vacuum ports 226*b-e*.

The provision of a hollow space within the frame of this embodiment allows installation of a pressure gauge for measurement of vacuum pressure within the hollow space. Advantageously, the pressure gauge is installed in the downstream longitudinal member where it can be easily viewed by an operator at the front of the shaker.

Embodiment 4: Screened Vacuum Enclosure with a Partially Hollow Outer Frame Body and Four Vacuum Ports Turning now to FIGS. 14 to 18, there is shown a fourth embodiment of the screened vacuum enclosure of the invention, wherein efforts are made to use similar reference numerals and labels to indicate similar features. The reference numerals are in the 300 series. This particular embodiment of the screened vacuum enclosure 310 is designed to exert vacuum pressure directly against only the downstream half of the surface area of the screen 332, although alternative embodiments may exert vacuum pressure directly against more or less than half of the surface area of the screen such as, for example, about two-thirds of the surface area, about three quarters of the surface area, about one-third of the surface area or about one quarter of the surface area of the screen 332, or any fraction of the surface area of the screen therebetween.

This particular embodiment of the screened vacuum enclosure 310 includes a frame 312 formed of exterior frame members 314*a*, 314*b*, 314*c* and 314*d*, interior transverse support frame members 318*a*, 318*b*, 318*c* and 318*d* and a single longitudinal inner support member 316 which forms the dividing line between the vacuum portion and the non-vacuum portion as described in more detail below.

Frame member 314*a* has vacuum ports 326*a*, 326*b*, 326*c* and 326*d* and as such is oriented at the front of the shaker during operation. As for previous embodiments, the vacuum ports 326*a*, 326*b*, 326*c* and 326*d* are configured for installation of corresponding hollow-body adapters 350*a*, 350*b*, 350*c* and 350*d* to facilitate connection of vacuum lines. In some embodiments, the vacuum ports 326*a-d* have sidewalls with threading to facilitate threading installation of the adapters 350*a-d*.

This embodiment also has a bottom floor 330 and a top screen 332 as similarly described for the previous embodiments. While the top screen 332 is generally similar to the top screens of the other embodiments, the floor 330 covers only about half of the interior area of the screened vacuum enclosure 310, with boundaries formed by the front halves of the transverse frame members 314*c* and 314*d*, the longitudinal support member 316 and the front longitudinal support member 314*a*. In addition, the floor 330 is generally sloped upwards from each transverse side toward a midpoint apex 331. As such the floor 330 has two sloped portions 330*a* and 330*b* which meet at the apex 331.

Figure 17:
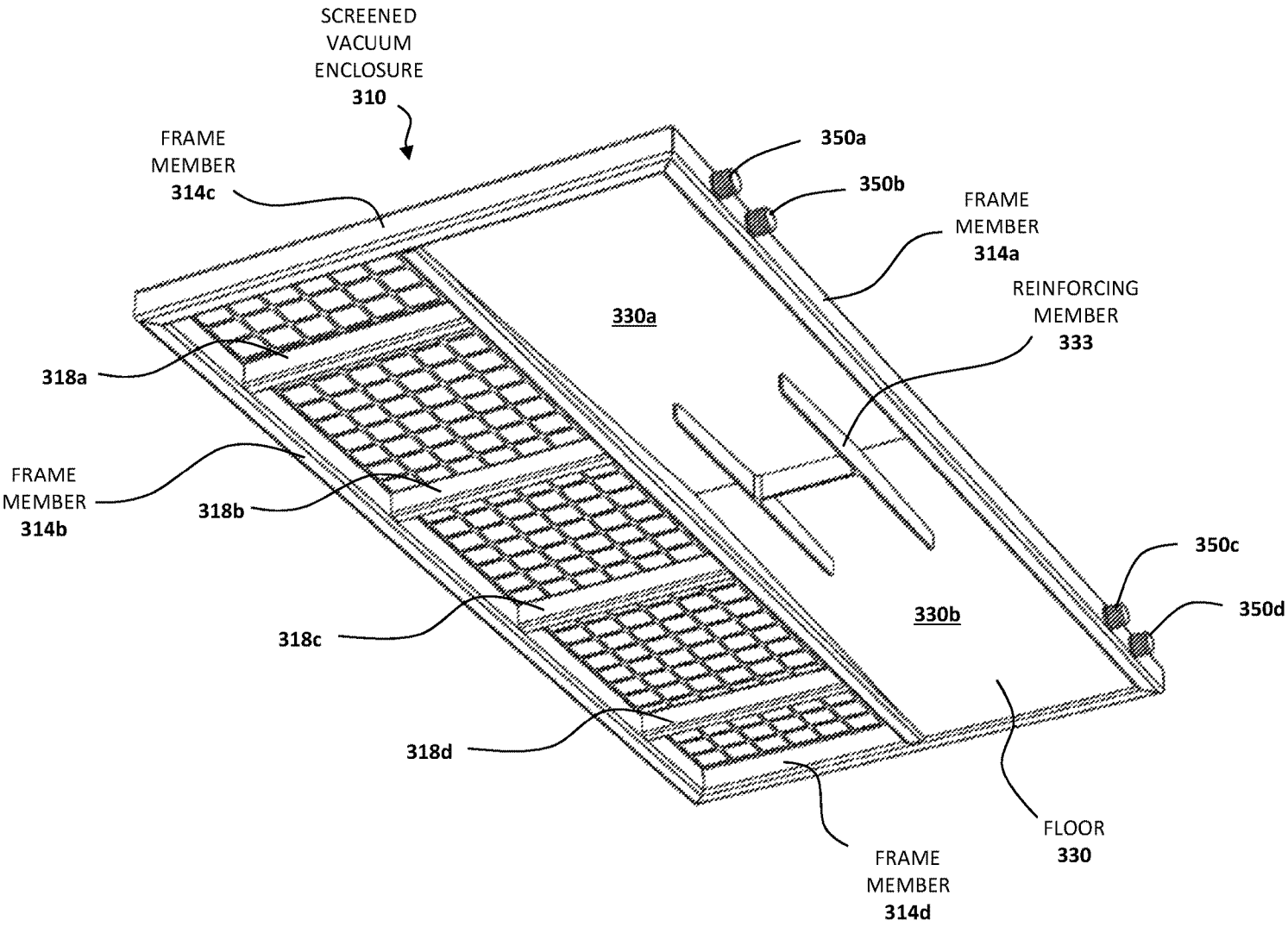
FIG. 17 is a bottom perspective view of the same embodiment of FIGS. 14-16.
Figure 18:
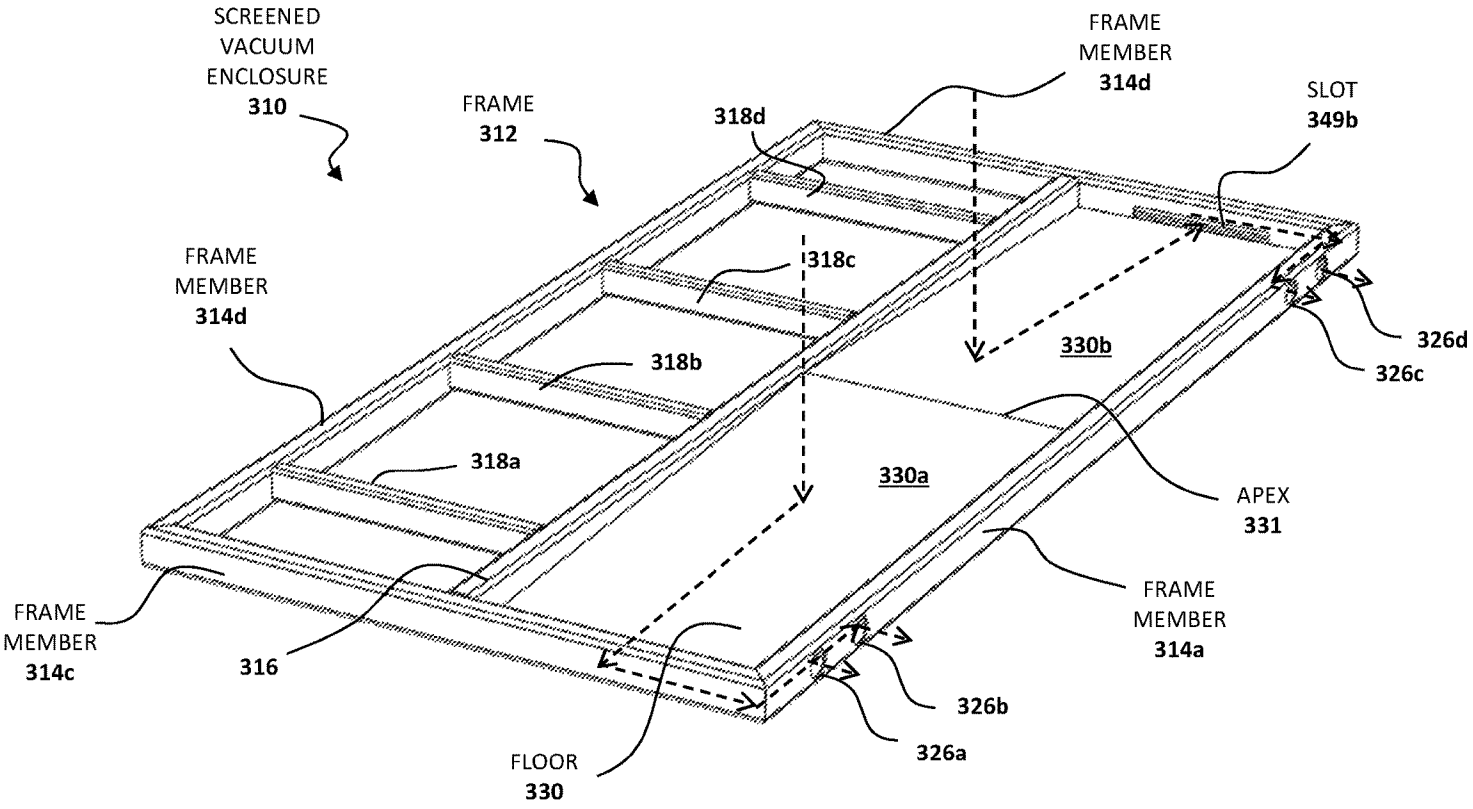
FIG. 18 is a top perspective view of the same embodiment of FIGS. 14-17 with the screen removed to illustrate the perspective of the floor 330 with respect to its framing members 314*a*, 314*c*, 316 and 314*d*.
Figure 19:
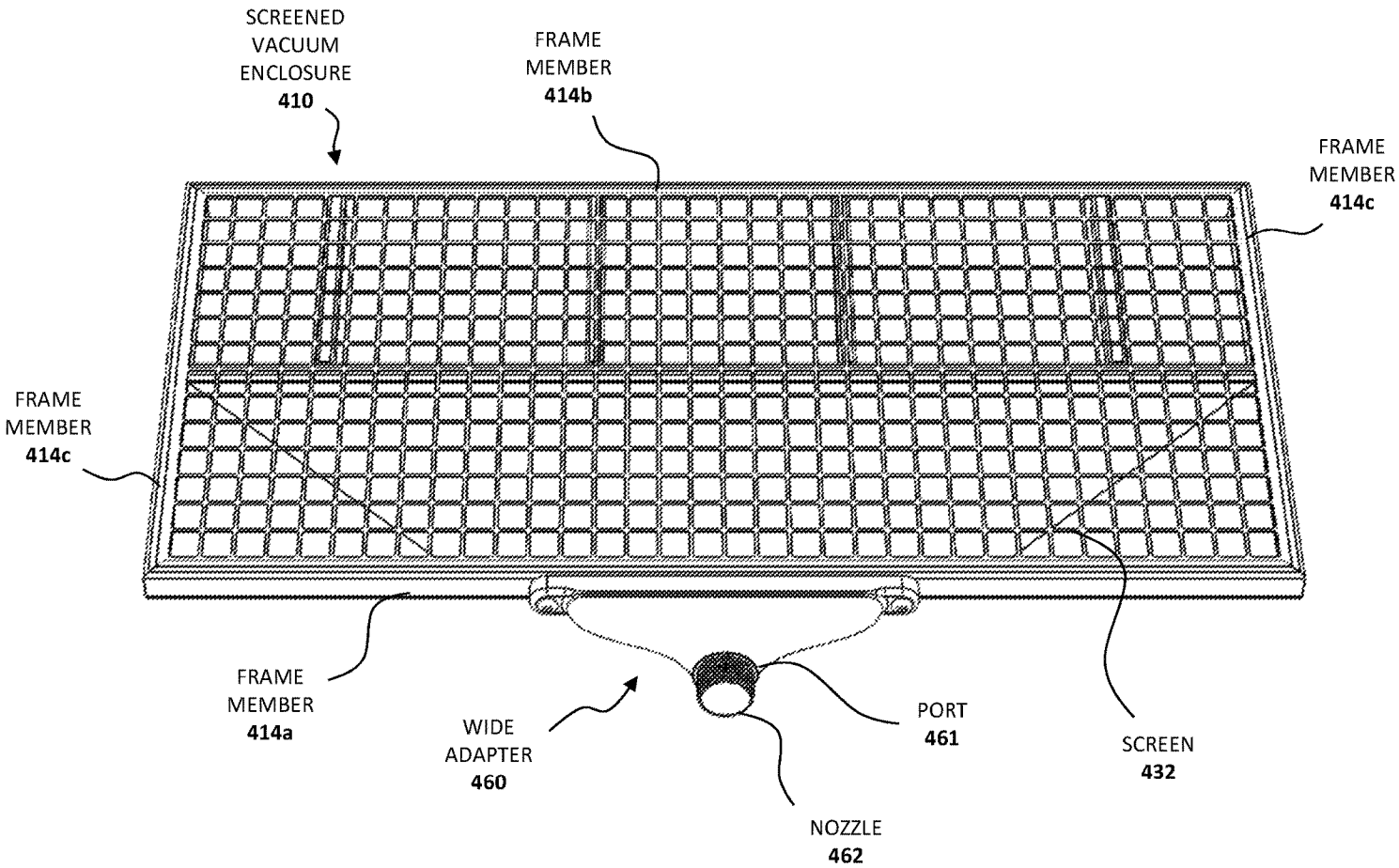
FIG. 19 is a top perspective view of a fourth embodiment of the screened vacuum enclosure 410 with a wide adapter 450 fitted to a front slot (not shown).

The purpose of structuring the floor 330 with the apex 331 is to reduce the total volume of space inside the screened vacuum enclosure below the screen 332 to make the vacuum pressure more effective and also to provide some gravity drainage of fluid collected in the screened vacuum enclosure 310. FIG. 17 shows a perspective view of the underside of the screened vacuum enclosure 310 for the purpose of illustrating an H-shaped reinforcing member 333 generally centered on and supporting the two sloped portions 330*a* and 330*b* of the floor 330. FIG. 18 shows a different perspective to indicate the sloped portions 330*a* and 330*b* of the floor 330. It can be seen in this perspective view that one side of the apex 331 of the floor 330 is joined close to the upper surface of the internal longitudinal support member 316 and the other side of the apex 331 of the floor 330 is joined close to the upper surface of the front frame member 314*a*. The two opposing transverse sides of the floor 330 are joined to frame members 314*c* and 314*d* near the bottom edges of these members and below the slots 349*a* and 349*b*.

The remaining half of the interior area of the frame 312 (the back half as shown in FIG. 18) has no floor and therefore drilling fluid passing through the screen 332 above this area drops into the fluid recovery area beneath the screen beds before the drill cuttings pass onto the portion of the screen 332 above the floor 330 where they are subjected to vacuum pressure.

As noted above and described in the previous embodiments, the vacuum ports 326*a*, 326*b*, 326*c* and 326*d* are provided in the forward facing exterior frame member 314*a*. However, as described above for embodiment 3, these vacuum ports do not extend through the opposite side of frame member 314*a* but instead join a hollow interior space within frame member 314*a*. In addition, frame members 314*c* and 314*d* are each provided with a single corresponding slot 349*a* and 349*b* opening into the floor area and the frame members 314*c* and 314*d* are continuously hollow at least as far as the back end of the slots 349*a* and 349*b* (slot 349*a* is visible in FIGS. 14-16 and slot 348*b* is seen only in the perspective view of FIG. 18). In this embodiment, all vacuum ports 326*a-d* are substantially identical circular openings. However, the skilled person will recognize that some variation in the shape of the ports is permissible.

The hollow portions of members 314*c* and 314*d* each join the hollow interior of member 314*a* for the purpose of providing a continuous hollow vacuum conduit extending from the vacuum ports 326*a*, 326*b*, 326*c* and 326*d* at least as far as the back of the slots 349*a* and 349*b*. In this particular embodiment, all exterior frame members 314*a*, 314*b*, 314*c* and 314*d* are hollow and interior walls are either installed within the hollow spaces of frame members 314*c* and 314*d* or formed integrally therewithin. In this particular example embodiment an interior wall 351*a* is shown inside the hollow space of member 314*c* is shown in the magnified perspective view of FIG. 16 which represents box F16 of FIG. 15. The purpose of this interior wall 351*a* (and a similar interior wall in member 314*d* (not shown)) is to form a rearward boundary for the interior hollow space. This decreases the total volume of the hollow interior space to make the vacuum pressure more effective. It is to be understood that providing vacuum throughout the entire exterior frame in this embodiment is not necessary because this embodiment requires provision of vacuum suction against only the front half of the screen 332. While this particular embodiment limits the front interior hollow space of the frame 312 by providing interior walls, other embodiments are possible where the rearward portions of frame members 314*c* and 314*d* are either of solid construction, or are hollow but filled with vacuum impervious filler material to provide boundaries in member 314*c* and 314*d* near or adjacent to the connection point of the interior longitudinal support member 316.

Figure 16:
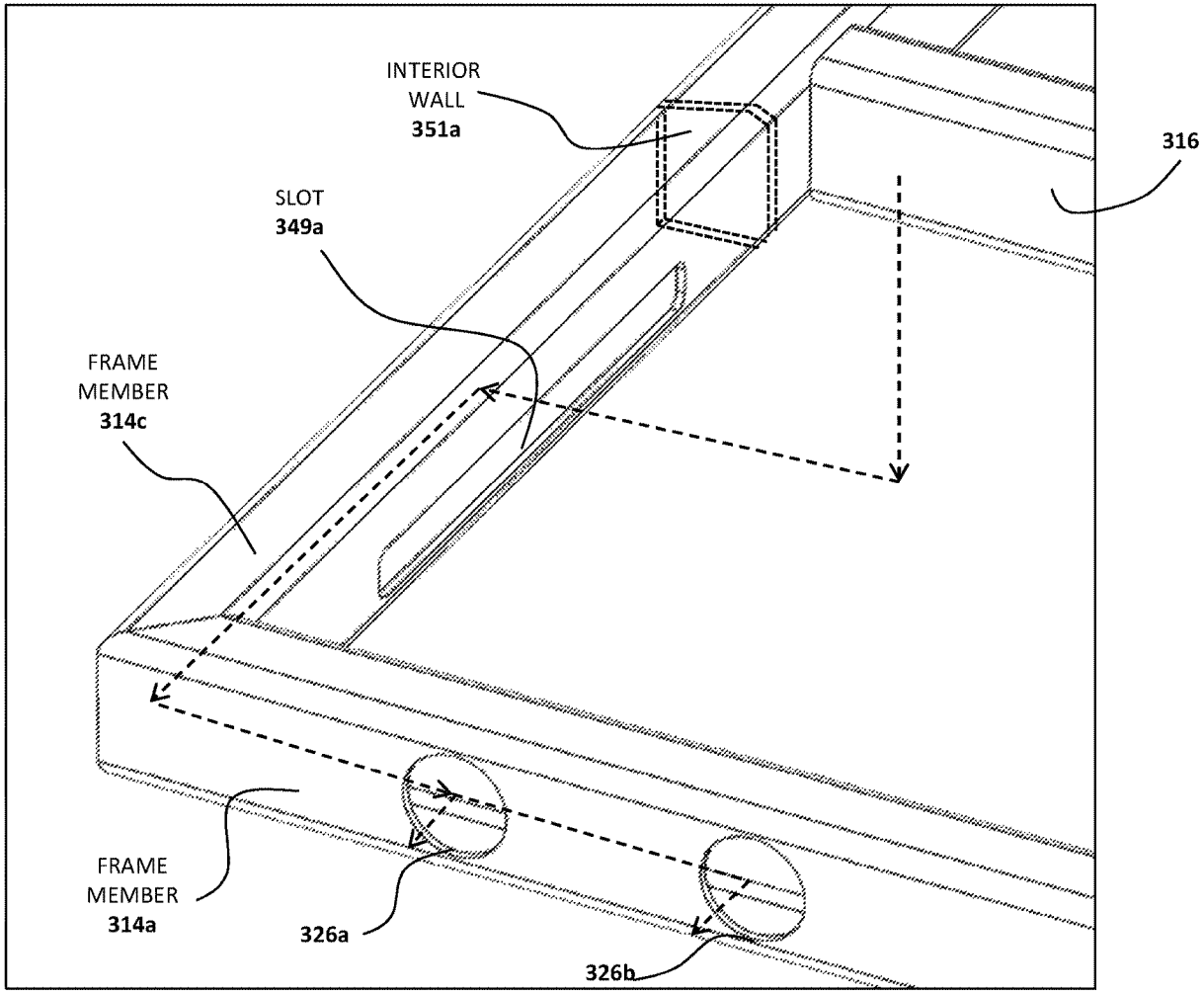
FIG. 16 is a magnified view of the inset 16' of FIG. 15 showing the general direction of air flow (with dashed arrows) downward into the enclosure 310, through slot 349*a*, through frame members 314*c* and 314*a* and out of ports 326*a* and 326*b*.

The general pattern of air flow under vacuum is now described with reference to FIG. 16 (which represents box F16 of FIG. 15) and FIG. 18. The dashed arrows show the general direction of air flow in this area when the screened vacuum enclosure 310 is under vacuum. While the ends of the arrows meet at right angles, the skilled person will recognize that this is a simplified representation made with the aim of preserving clarity regarding the general direction of airflow. It is to be understood that during operation of the screened vacuum enclosure 310 under vacuum pressure applied at the vacuum ports 326*a-d*, air is drawn down from above the screen as indicated by the vertical arrows and then moves toward the slot 349*a* in frame member 314*c* and the slot 349*b* in frame member 314*d* (with the latter is seen only in FIG. 18). After entering the slots 349*a* and 349*b*, the air flow moves within the continuous hollow space at the front of the outer frame 312 and out of the screened vacuum enclosure 310 via the vacuum ports 326*a-d*.

The skilled person will recognize that pumping of wash fluid into the front hollow portion of the frame 312 may be performed in a similar manner as described for embodiment 3, in order to dislodge obstructions. Such obstructions are dislodged through the slots 349*a* and 349*b* into the interior of the screened vacuum enclosure 310.

As for embodiment 3, the provision of a hollow space within the frame of this embodiment allows installation of a pressure gauge for measurement of vacuum pressure within the hollow space. Advantageously, in certain embodiments, the pressure gauge is installed in the downstream longitudinal member where it can be easily viewed by an operator at the front of the shaker.

As described for embodiment 3, the present embodiment may be configured for washing to remove obstructions by pumping of washing fluid into the device.

Embodiment 5: Screened Vacuum Enclosure with a Single Front Adapter and Vacuum Port Turning now to FIGS. 19 to 22, there is shown a fifth embodiment of the screened vacuum enclosure of the invention, wherein efforts are made to use similar reference numerals and labels to indicate similar features. The reference numerals are in the 400 series. This particular embodiment of the screened vacuum enclosure 410 is designed to provide vacuum suction directly against only the downstream half of the surface area of the screen 432, although, as described above for embodiment 4, alternative embodiments may provide vacuum suction directly against more or less than half of the surface area of the screen such as, for example, about two-thirds of the surface area, about three quarters of the surface area, about one-third of the surface area or about one quarter of the surface area of the screen, or any fraction of the surface area of the screen therebetween.

This particular embodiment of the screened vacuum enclosure 410 includes a frame 412 formed of exterior frame members 414*a*, 414*b*, 414*c* and 414*d*, interior transverse support frame members 418*a*, 418*b*, 418*c* and 418*d* and a single longitudinal support member 416 which forms the dividing line between the vacuum portion and the non-vacuum portion as described in more detail below.

Figure 20:
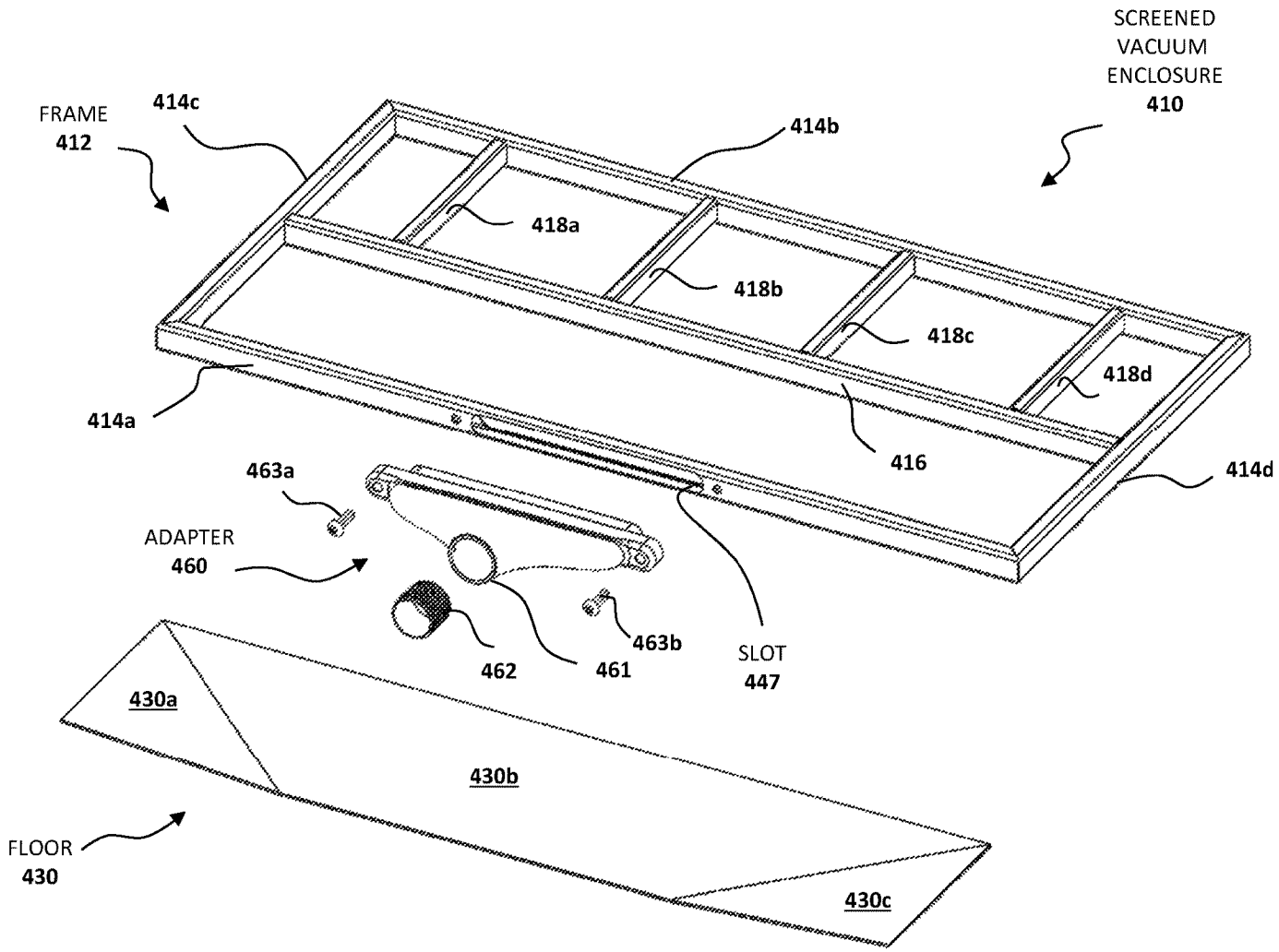
FIG. 20 is an exploded perspective view of the same embodiment of FIG. 19 showing some of the features of the adapter 460.
Figure 21B:
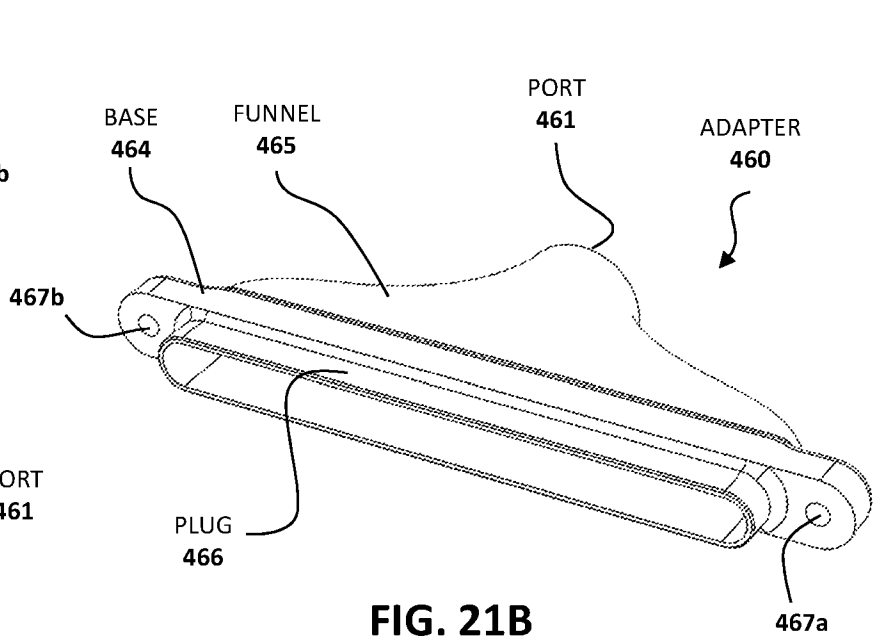
FIGS. 21A and 21B are perspective views of the adapter 460 of the embodiment of FIGS. 19 and 20.
Figure 21A:
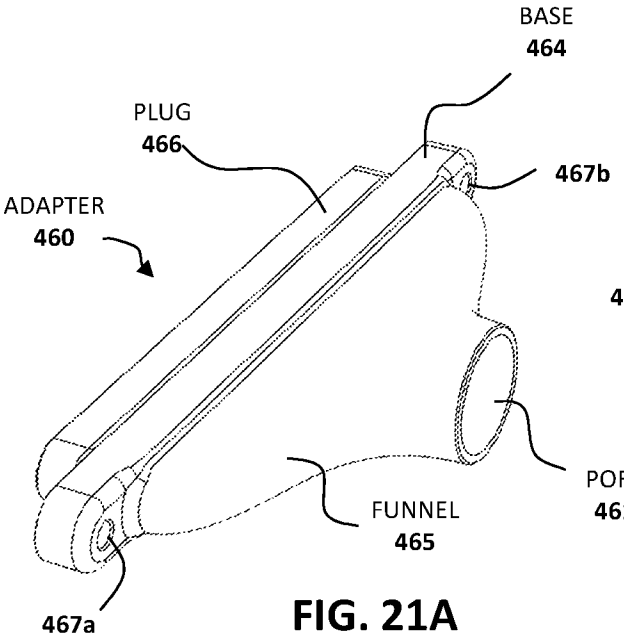
Figure 21C:
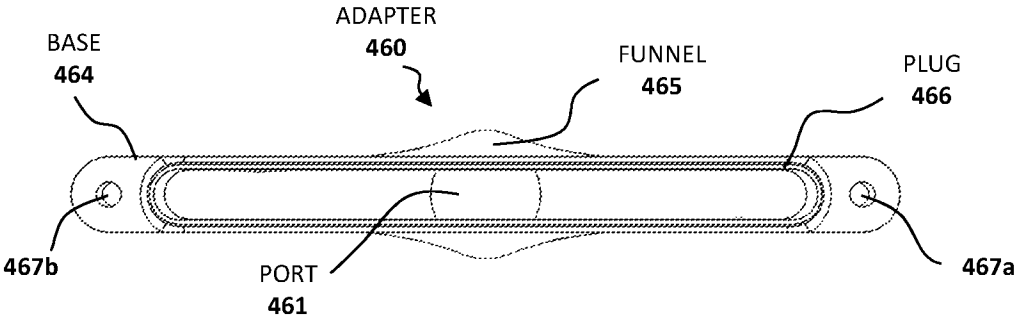
FIG. 21C is a side elevation view of the back of the adapter 460 of the embodiment of FIGS. 19, 20, 21A and 21B.

Frame member 414*a* has a generally centered slot 447 for installation of an adapter 460 whose structure is shown in detail in three different views in FIGS. 21A-C. The adapter 460 of this particular embodiment is of unitary construction and advantageously formed by injection molding according to known methods. Alternative embodiments of the adapter may be constructed of separate parts. The adapter 460 includes a base 464 with an integral plug portion 466 extending therefrom which is configured for press-fit installation in the slot 447 of the screened vacuum enclosure 410. The base 464 acts as a stop for the press-fit arrangement and provides a means for connection of the adapter 460 to the front frame member 414*a*. In the present embodiment, the connection is made with a pair of bolts 463*a* and 463*b* (see FIG. 20) which fit in bolt holes 467*a* and 467*b* shown in greater detail in FIG. 21. Other means of connection of the adapter 460 to the front frame member 414*a* are possible, such as adhesives applied to the back side of the base 464 of the adapter. The front side of the adapter 464 transitions to a funnel portion 465 which terminates in a port 461. Advantageously, the interior sidewall of the port 461 is provided with threads to allow threading connection of a nozzle 462 to facilitate connection of a single vacuum line.

This embodiment also has a bottom floor 430 and a top screen 432 as similarly described for the previous embodiments. While the top screen 432 is generally similar to the top screens of the other embodiments, the floor 430 covers only about half of the interior area of the screened vacuum enclosure 410, as for embodiment 4, with boundaries formed by the front halves of the transverse frame members 414*c* and 414*d*, the longitudinal support member 416 and the front longitudinal support member 414*a*.

The three dimensional structure of the floor differs from the floor 330 of embodiment 4 by having three separately sloped portions 430*a*, 430*b* and 430*c*. Sloped floor portions 430*a* and 430*b* are triangular and diagonally sloped downwards from their respective front corners to promote flow of drilling fluid towards the center of the floor at portion 430*b*. As such, the highest point of floor portion 430*a* is at the front left corner of the screened vacuum enclosure 410 where the front longitudinal frame member 414*a* meets the left transverse frame member 413*c*. Likewise, the highest point of the of floor portion 430*c* is at the front right corner of the screened vacuum enclosure 410 where the front longitudinal frame member 414*a* meets the left transverse frame member 413*d*. As noted above, floor portion 430*b*, which is a trapezoidal shape, is also sloped. The slope of floor portion 430*b* is downward from a plane near the top edge of the inner longitudinal support member 416 to a plane near the bottom edge of the front longitudinal frame member 414*a* below the slot 447. The purpose of structuring the floor 430 with the sloped portions 430*a-c* is to reduce the total volume of space inside the screened vacuum enclosure below the screen 432 to make the vacuum pressure more effective and to promote gravity flow of fluid toward the slot.

Figure 22:
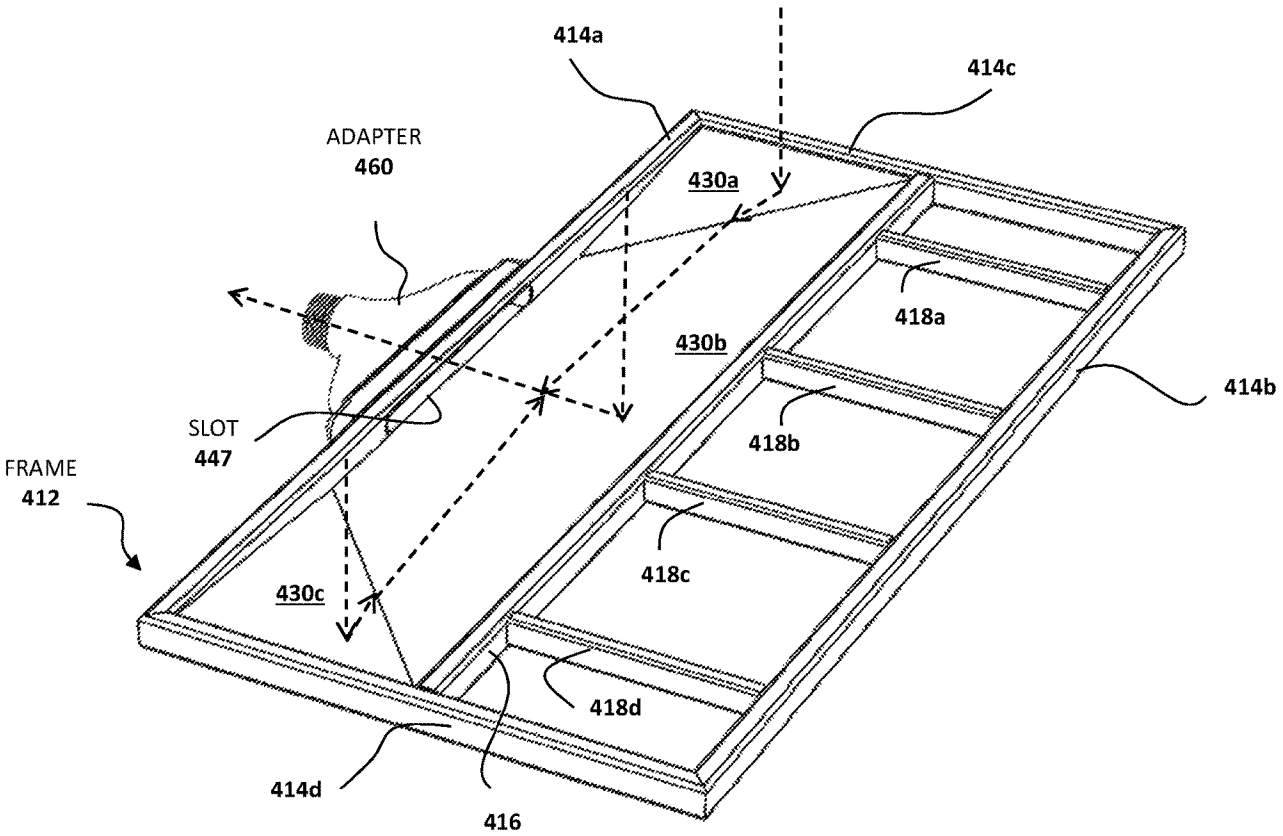
FIG. 22 is a top perspective vie of the same embodiment of FIGS. 19-21 with the screen removed.

The remaining half of the interior area of the frame 412 (the back half as shown in FIGS. 20 and 22) has no floor and therefore drilling fluid passing through the screen 432 above this area drops into the fluid recovery area beneath the screen beds before the drill cuttings pass onto the portion of the screen 432 above the floor 430 where they are subjected to vacuum pressure.

One notable difference between embodiment 4 and the present embodiment is that it is not a requirement for any of the frame members 414*a-d* or portions thereof to be hollow, although they may be hollow if desired, provided that boundaries such as walls or vacuum impervious filler are provided on each side of the slot 447, to prevent vacuum from being pulled through the frame 412 (as this would decrease the efficiency of the system. As such, the vacuum suction is concentrated above the floor 430 of the screened vacuum enclosure 410.

The general pattern of air flow under vacuum is now described with reference to FIG. 22. The dashed arrows show the general direction of air flow in this area when the screened vacuum enclosure 410 is under vacuum. While the ends of the arrows meet at right angles in most cases, the skilled person will recognize that this is a simplified representation made with the aim of preserving clarity regarding the general direction of airflow, as described above for the other embodiments. It is to be understood that during operation of the screened vacuum enclosure 410 under vacuum pressure applied at the nozzle 462, air is drawn down from above the screen as indicated by the vertical arrows and then moves toward the slot 447 in frame member 414*a*.

The skilled person will recognize that pumping of wash fluid into the screened vacuum enclosure 410 may be performed in a similar manner as described for embodiments 3 and 4, in order to dislodge obstructions within the funnel portion 465 of the adapter 460. Such obstructions are dislodged through the slot 447 into the interior of the screened vacuum enclosure 410.

One advantage of this embodiment relative to the other embodiments described hereinabove is that because there is only one vacuum port 461, there is no need to provide a vacuum distributor when the screened vacuum enclosure 410 is incorporated into a vacuum-based shaker system (see FIG. 26 which is described hereinbelow).

As for embodiments 3 and 4, the provision of a hollow space within the frame of this embodiment allows installation of a pressure gauge for measurement of vacuum pressure within the hollow space. Advantageously, in certain embodiments, the pressure gauge is installed in the downstream longitudinal member where it can be easily viewed by an operator at the front of the shaker.

As described for embodiments 3 and 4, the present embodiment may be configured for washing to remove obstructions by pumping of washing fluid into the device.

Additional Features of Embodiments of Screened Vacuum Enclosures

Materials used for construction of the frame members of various embodiments of vacuum enclosures of the present invention may include wood, plastic or metal and may be determined without undue experimentation. Advantageously, the materials are lightweight to minimize addition of extra loads to the shaker. It is known in the art that binding agents can be used bind the screen mesh to the screen frame with maximal adhesion to both materials while being able to handle high heat, strong vibration, abrasive cuttings and corrosive drilling fluids. Plastic composite screens tend not to use adhesives but rather heat the mesh and melt it into the screen frame to form a bond. Such binding agents may be adapted to construct various embodiments of the screened vacuum enclosure without undue experimentation.

Vacuum Shaker Systems Using Embodiments of the Screened Vacuum Enclosure

In accordance with another aspect of the invention, the screened vacuum enclosure is used as part of a vacuum-based shaker system for separation of drilling fluid from drill cuttings.

In FIGS. 23 to 26, there are shown various embodiments of vacuum-shaker systems using embodiments of the screened vacuum enclosure of the present invention in association with a similar shaker 1 of the type which has a series of four screen beds 3*a*, 3*b*, 3*c* and 3*d*. While screen frames are absent from the upstream screen beds 3*b*, 3*c* and 3*d*, it is to be understood that screen frames would be present during operation of the shaker 1 when drill cuttings are dropped onto the screen of the most upstream screen bed 3*d* and proceed downstream over the screens of screen beds 3*c*, 3*b* and finally, the various embodiments of the screened vacuum enclosure. For greater clarity, the screened vacuum enclosure is placed on the shaker 1 at the downstream end of the shaker and the connections to a vacuum distributor 40 (or directly to a vacuum source in the case of the system of FIG. 26) are made at the downstream longitudinal member of the screened vacuum enclosure.

In certain alternative embodiments, each one of the three upstream screen beds 3*b*, 3*c* and 3*d* has a screened vacuum enclosure placed thereon. These three screened vacuum enclosures are modified to function simply as screen frames by closure of each of the nine vacuum ports. More detail of this modification is provided hereinbelow.

Figure 23B:
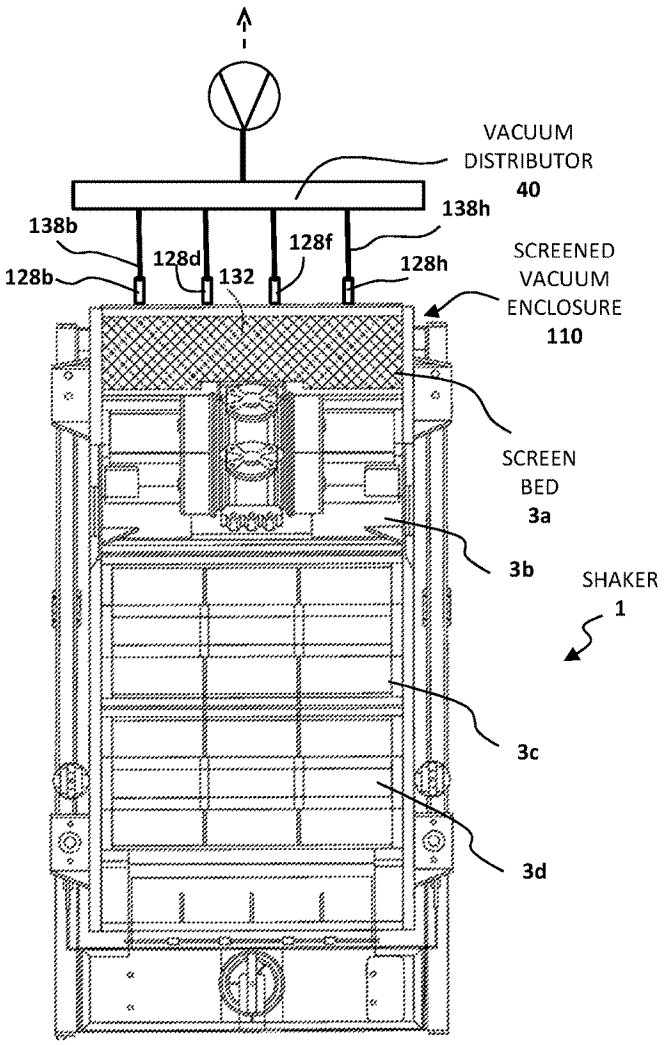
FIG. 23B is a top plan view of a vacuum shaker system showing installation of screened vacuum enclosure 110 on a shaker 1 and having four vacuum pipes connected to a vacuum distributor 40.
Figure 23A:
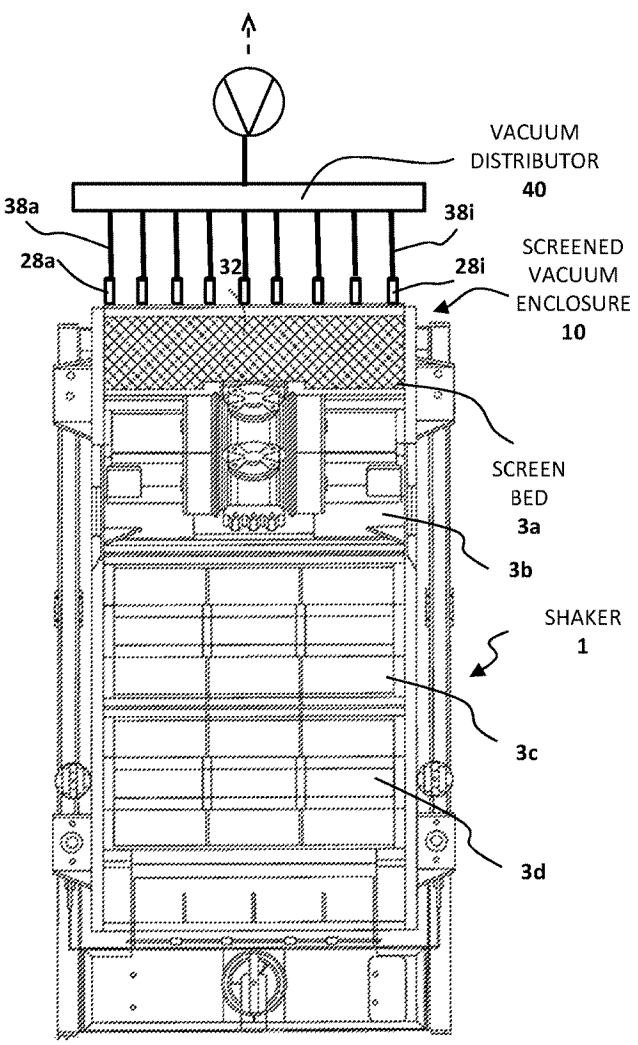
FIG. 23A is a top plan view of a vacuum shaker system showing installation of screened vacuum enclosure 10 on a shaker 1 and having nine vacuum pipes connected to a vacuum distributor 40.

Referring now to FIG. 23A, it is seen that screen bed 3*a* holds a screened vacuum enclosure 10 which has vacuum pipes 26*a*-26*i* extending from its downstream end. Each one of the vacuum pipes 26*a*-26*i* is connected to a corresponding vacuum line 38*a*-38*i*. For the sake of clarity, vacuum pipes 26*b*-26*h* and vacuum lines 38*b*-38*h* are not labelled but their positions are understood in context of the positions of vacuum pipes 26*a* and 26*i* and corresponding vacuum lines 38*a* and 38*i*. Each of the vacuum lines 38*a*-38*i* is connected to a vacuum distributor 40 whose function is to disperse a centralized vacuum pressure provided by a vacuum pump or other source to each of the vacuum lines 38*a*-38*i*. Advantageously, the vacuum distributor 40 is configured for variable connection and closure of vacuum connections to provide flexibility and compatibility with various embodiments of the screened vacuum enclosure of the present invention. Therefore, vacuum ports or connections (not shown) in the vacuum distributor 40 will be provided with closures or plugs so that the vacuum pressure in the distributor may be preserved in the event that a vacuum line is not connected thereto. Such closure elements are understood to be in use in the system embodiment shown in FIG. 14B which is described below.

Referring now to FIG. 23B, there is shown a shaker 1 as shown in FIG. 23A and described above. The downstream screen bed 3*a* of the shaker 1 is provided with a screened vacuum enclosure 110 as described above with respect to FIGS. 4 to 6 (embodiment 2). It is seen that four vacuum pipes 128*b*, 128*d*, 128*f* and 128*h* extend from the downstream end of the screened vacuum enclosure 110. Each of these vacuum pipes 128*b*, 128*d*, 128*f* and 128*h* is connected to a corresponding vacuum line 138*b*, 138*d*, 138*f* and 138*h* (labels for 138*d* and 138*f* are omitted to preserve clarity but their positions are known from context). These vacuum lines 138*b*, 138*d*, 138*f* and 138*h* are connected to a vacuum distributor 40 which is configured for specific use with this embodiment of the screened vacuum enclosure 110, by closure of connectors or ports which are not intended to be used. The connectors or ports are provided with switches or valves for this function in certain embodiments, according to known arrangements which may be adapted for use with the vacuum distributor, without undue experimentation.

Figure 24A:
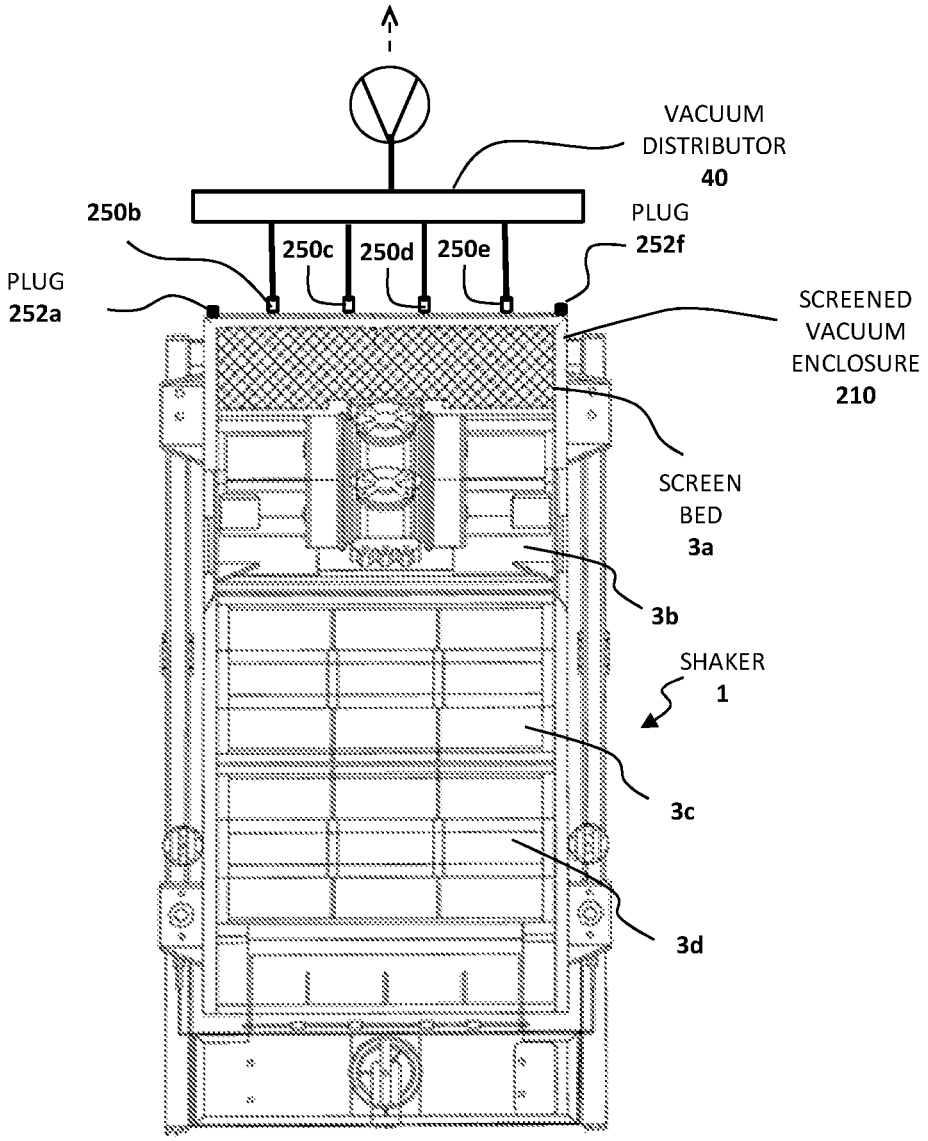
FIG. 24A is a top plan view of a vacuum shaker system showing installation of screened vacuum enclosure 210 on a shaker 1 and having four adapters 250*b-e* and two plugs 252*a* and 252*f* connected to the screened vacuum enclosure 210. The four adapters 250*b-e* are connected to a vacuum distributor 40.

Turning now to FIG. 24A, there is shown a system with a shaker 1 similar to the shown in FIG. 23A and described above. The downstream screen bed 3*a* of the shaker 1 is provided with a screened vacuum enclosure 210 as described above with respect to FIGS. 7 to 13 (embodiment 3). Among the vacuum ports of the screened vacuum enclosure, ports 226*a* and 226*f* (not labelled in FIG. 24A) are provided with plugs 252*a* and 252*f*. The remaining vacuum ports 226*b-e* (not labelled in FIG. 24A) are connected to adapters 250*b-e*. Adapters 250*b-e* are connected to a vacuum distributor and the system will provide vacuum suction through the screened vacuum enclosure 210 in a manner similar to that shown in FIG. 23A.

Figure 24B:
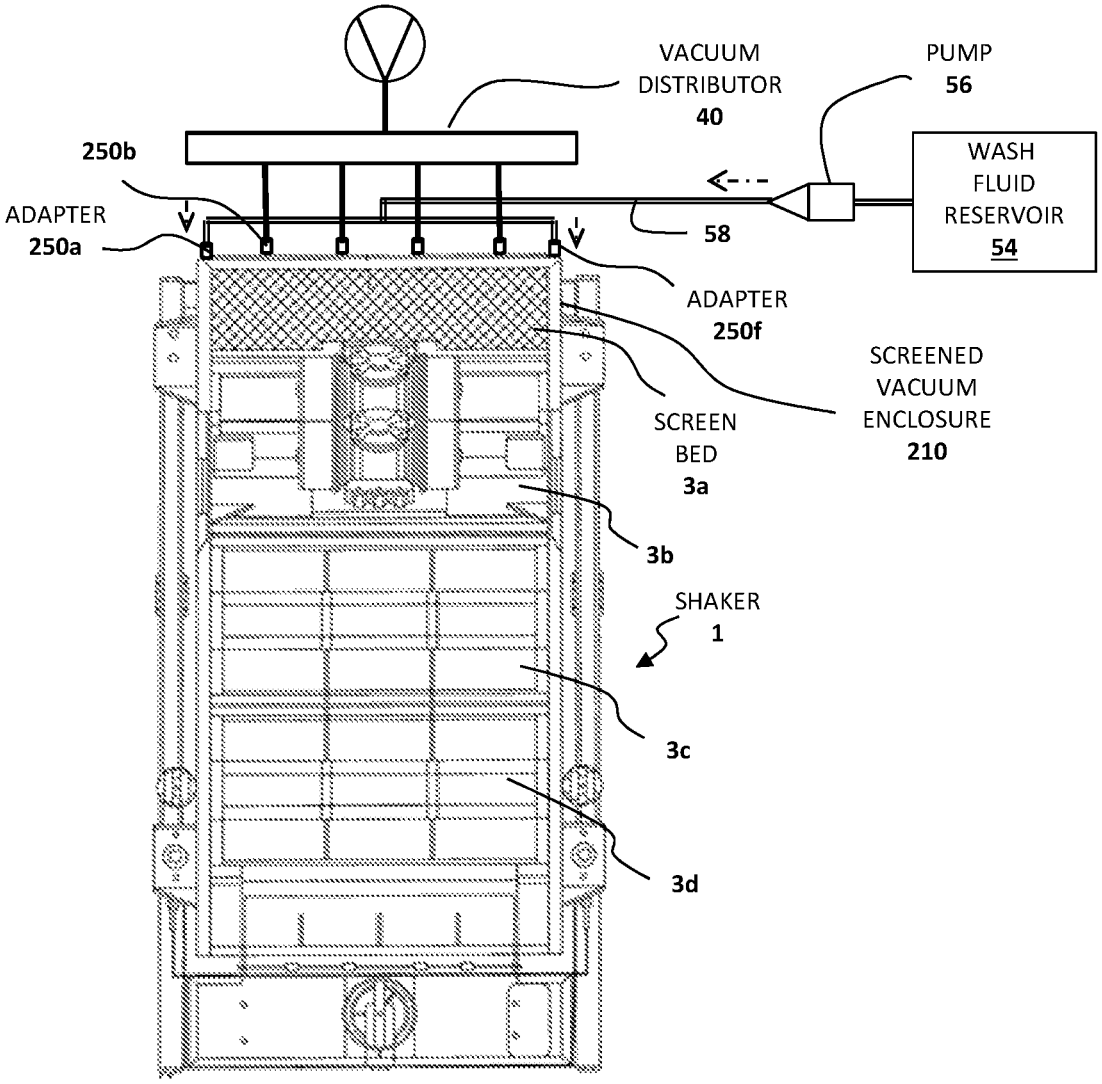
FIG. 24B is a top plan view of a vacuum shaker system showing installation of screened vacuum enclosure 210 on a shaker 1 and having six adapters 250*a-f* connected to the screened vacuum enclosure 210. Adapters 250*a* and 250*f* are connected to a wash fluid reservoir 54 and pump 56 via bifurcated wash line 58. This system is provides a means for flushing out blockages inside the hollow body of the screened vacuum enclosure 210. The remaining adapters are connected to the vacuum distributor 40.

FIG. 24B illustrates a system similar to that shown in FIG. 15A, but with added functionality provided by connection of a washing module comprising a pump line 58 connected to adapters 250*a* and 250*f* which replace the plugs 252*a* and 252*f* of the system of FIG. 15A. Pump line 58 includes a pump 56 for drawing wash fluid from a wash fluid reservoir 58. In operation, the pump draws fluid from the reservoir 54 and pumps it at a high rate into the hollow body frame of the screened vacuum enclosure 210 via pump line 54 and adapters 250*a* and 250*f*. Any obstructions within the hollow body frame will be dislodged and expelled from the hollow body frame via the slots in the back frame member 214*b* and ideally broken up into smaller pieces that can be subsequently vacuumed out. The skilled person will recognize that the washing step may be performed concurrently with the provision of vacuum pressure to the adapters 250*b-f* or the washing step may be performed alone and alternate with the provision of vacuum pressure to the adapters 250*b-f*.

Figure 24C:
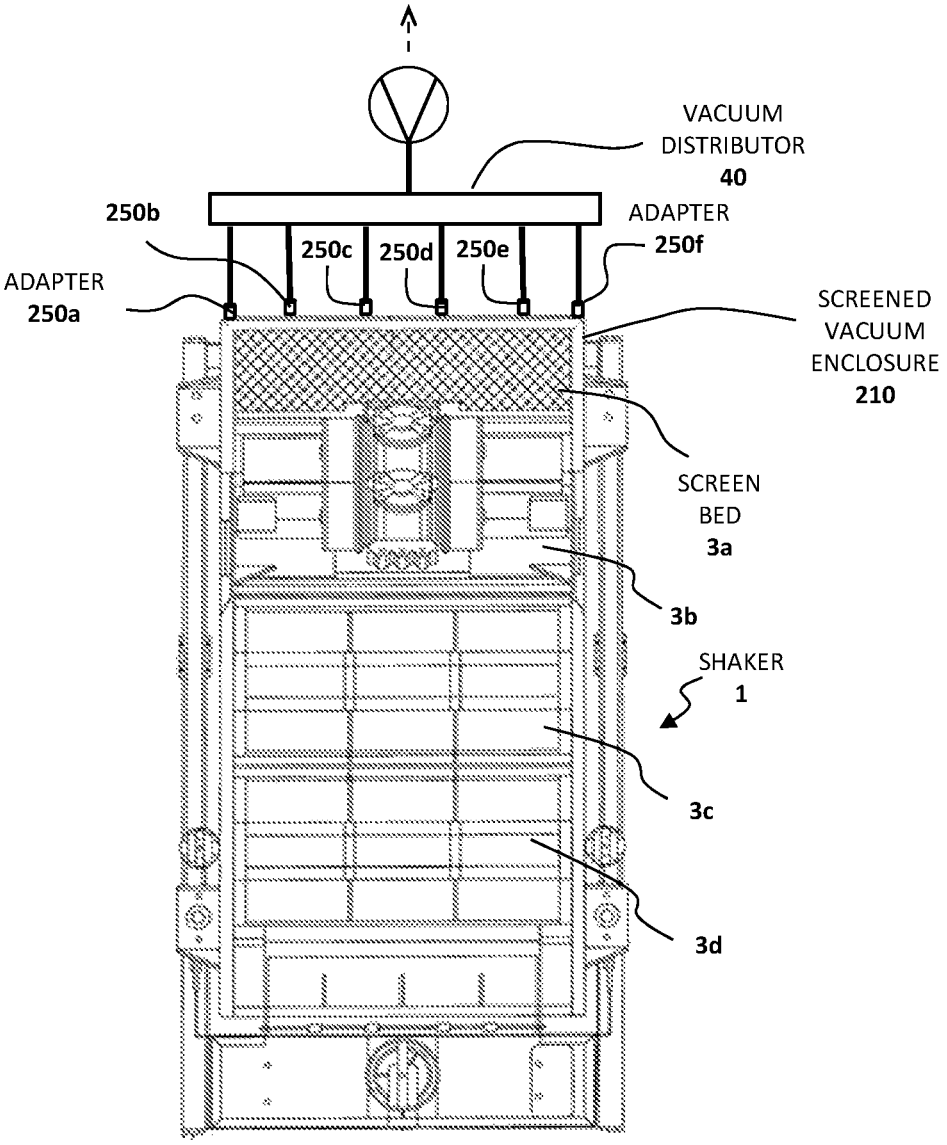
FIG. 24C is a top plan view of a vacuum shaker system showing installation of screened vacuum enclosure 210 on a shaker 1 and having six adapters 250*a-f* connected to the screened vacuum enclosure 210. Each of the six adapters 250*a-f* is connected to the vacuum distributor 40.

Shown in FIG. 24C is another system arrangement highlighting the versatility of the screened vacuum enclosure 210. In this system embodiment, adapters 250*a* and 250*f* are connected to vacuum ports 226*a* and 226*f* as shown in FIG. 15B, but in this case, the adapters 250*a* and 250*f* are connected to the vacuum distributor 40 to provide a variation in vacuum-driven air flow through the hollow frame body of the screened vacuum enclosure 210.

The skilled person will readily recognize that a number of variations in connections between the vacuum distributor 40 and the vacuum ports are possible. The vacuum ports 226*a-f* may be provided with inner threads which facilitate the process of making connections to adapters, plugs or even direct connection of threaded vacuum conduits which extend to a vacuum distributor or vacuum sources. In certain embodiments, each vacuum line extending to each vacuum port may be controlled individually to increase or decrease vacuum pressure provided to the hollow frame body of the screened vacuum enclosure 210. This will alter the air flow dynamics within the hollow body of the screened vacuum enclosure 210 to alter the vacuum-driven air flow on the screen to facilitate separation of drilling fluids of different consistencies from drill cuttings with different characteristics with the aim of achieving an optimal balance between recovery of optimal volumes of drilling fluid with minimal generation of undesired fine particles of drill cuttings.

Figure 25:
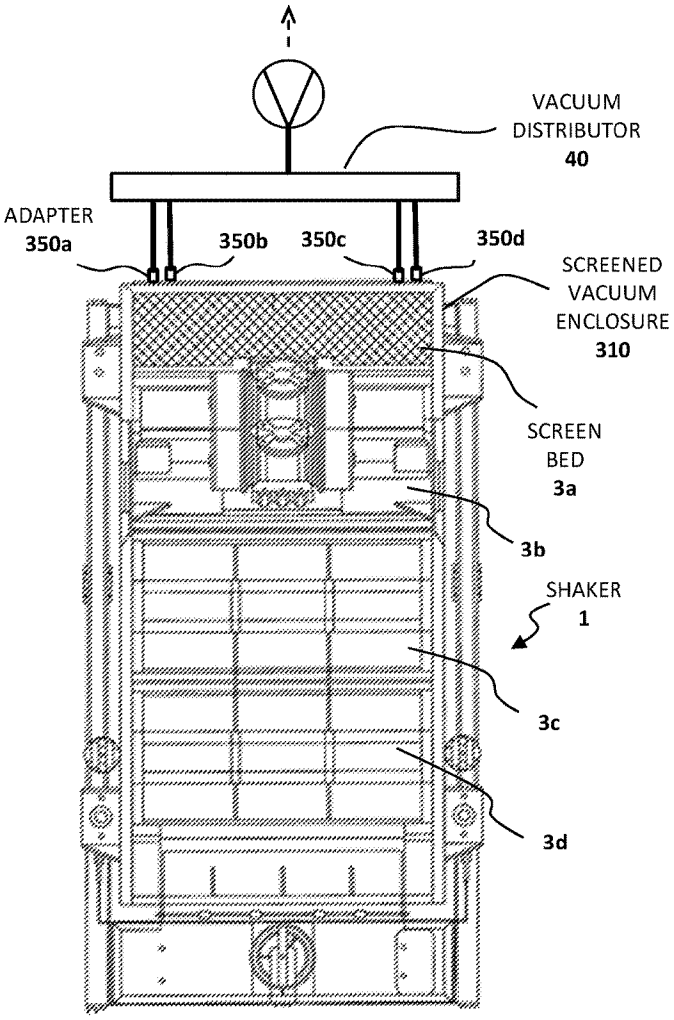
FIG. 25 is a top plan view of a vacuum shaker system showing installation of screened vacuum enclosure 310 on a shaker 1 and having four adapters 350*a-d* connected to the screened vacuum enclosure 310. Each of the four adapters 350*a-d* is connected to the vacuum distributor 40.

Referring now to FIG. 25, there is shown a shaker 1 as described for the other systems described hereinabove. The downstream screen bed 3*a* of the shaker 1 is provided with a screened vacuum enclosure 310 as described above with respect to FIGS. 14 to 18 (embodiment 4). It is seen that four adapters 350*a*, 350*b*, 350*c* and 350*d* extend from the downstream end of the screened vacuum enclosure 310. Each of these four adapters 350*a*, 350*b*, 350*c* and 350*d* is connected to a corresponding vacuum line. The vacuum lines are connected to a vacuum distributor 40 which is configured for specific use with this embodiment of the screened vacuum enclosure 310.

Figure 26:
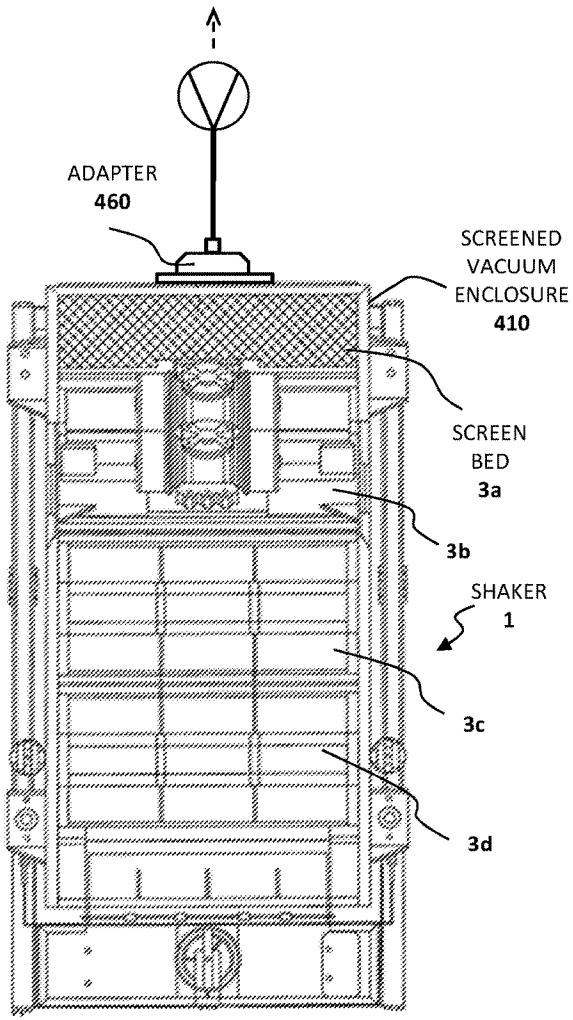
FIG. 26 is a top plan view of a vacuum shaker system showing installation of screened vacuum enclosure 410 on a shaker 1 and having a single adapter 460 connected to the screened vacuum enclosure 410 which is directly connected to the vacuum source.

Referring now to FIG. 26, there is shown a shaker 1 as described for the other systems described hereinabove. The downstream screen bed 3*a* of the shaker 1 is provided with a screened vacuum enclosure 410 as described above with respect to FIGS. 19 to 22 (embodiment 5). It is seen that a single adapter 460 extends from the downstream end of the screened vacuum enclosure 410 and is connected to a single vacuum line. The vacuum line is connected to a vacuum source. This embodiment provides the simplest arrangement of equipment at the front of the shaker and can be operated without a vacuum distributor as shown.

The use of a screened vacuum enclosure on a downstream screen bed may require additional modification of the vacuum shaker system for optimal operation. In one particular situation, it may be advantageous to have one or more of the upstream screens placed at the same level as the screen of the screened vacuum enclosure so that drill cuttings can vibrate off the upstream screen directly onto the downstream screen of the screened vacuum enclosure. It is expected that most existing screen frames will have a narrower depth than that of the screened vacuum enclosure and this differential depth will pose a problem if it is desired that the upstream and downstream screens are placed at the same level.

This problem is conveniently addressed by configuring one or more substantially identical screened vacuum enclosures to function solely as screen frames by installing plugs in all of the vacuum ports and placing these modified screened vacuum enclosures on one or more of the upstream screen beds. Since the depth of the screened vacuum enclosures is substantially identical, the levels of all of the screens should be substantially identical. If it is found that the plugs prevent adequate alignment of the adjacent longitudinal outer frame members of adjacent screened vacuum enclosures, the outer frame members may be fitted with gaskets to bridge the gaps between the adjacent screened vacuum enclosures. The manner of constructing and fitting of gaskets to the screened vacuum enclosures is within the knowledge of the person skilled in the art.

In all example embodiments described herein, the vacuum ports are located on the front side surface of the downstream longitudinal member. Alternative embodiments have ports located on the underside of either the downstream or upstream longitudinal member. The provision of ports in the upper surfaces of the upstream or downstream longitudinal members is also possible, but expected to be less advantageous because of potential interference with the movement of drill cuttings across the screen of the screened vacuum enclosure.

EXAMPLES

Example 1: A Kit for Assembly of Embodiments 1 and 2

As understood by the foregoing description, alternative embodiments of the first and second embodiment of the screened vacuum enclosure may be constructed which employ any number of vacuum ports and vacuum pipes. While the maximum number of vacuum ports and pipes in the embodiments described above is nine ports and nine pipes, the skilled person will recognize that it is possible to design alternative embodiments with more ports and pipes. Such alternatives are also within the scope of the invention. Advantageously, both of the embodiments described above and additional embodiments may be constructed using the example kit described below.

In the present example, there is provided a kit for assembly of screened vacuum enclosures of embodiments 1 and 2 for use in separating drilling fluid from drill cuttings on a shaker. In one embodiment, the kit comprises outer frame members including two longitudinal outer frame members and two transverse outer frame members and inner frame members including two longitudinal inner frame members and two transverse inner frame members. The kit also includes a covering floor structure designed to substantially cover the bottom of the frame. An adhesive for attaching the floor to the lower surface of the frame and for attaching a commercially obtained screen to the upper surface of the frame may also be provided.

The transverse outer frame members include a set of notches for holding the ends of inner longitudinal frame members. The two longitudinal inner frame members are each provided with two different sets of openings along their length. One set of openings has two rectangular openings provided to allow passage of the two transverse inner frame members to hold them in place in relation to the inner longitudinal members, thereby forming a rigid double cross-like structure. The other set of openings are round openings provided to hold the vacuum pipes. This double cross-like structure is installed inside the outer frame. The floor is attached either before or after the vacuum pipes are inserted according to the desired configuration. Lastly, the screen is attached. This structure can then be placed on the screen bed of a shaker and the vacuum conduit lines can be attached to the vacuum pipes. The vacuum lines extend to a vacuum distributor which is connected by a main vacuum conduit to a vacuum source and a drilling fluid storage tank.

An example of a process of assembly of two different embodiments of the screened vacuum enclosure is now described with reference to components and features best illustrated in FIGS. 3 and 6.

(1) Align the longitudinal inner frame members 16*a* and 16*b* so that their corresponding pairs of square or rectangular holes 20*s*/20*u* and 20*q*/20*v* are aligned;

(2) Push transverse member 18*a* through holes 20*s*/20*u* and push transverse member 18*b* through holes 20*t*/20*v*. The result of this process yields a rigid double cross-like inner structure;

(3) Assemble the outer frame by connecting the outer frame members 14*a*, 14*b*, 14*c* and 14*db* at their ends to form a rectangular-shaped outer frame 12.

(4) Insert the inner double-cross structure into the frame 12 by fitting the ends of the longitudinal members 16*a* and 16*b* into corresponding notches 22*w*, 22*x*, 22*y* and 22*z* in the transverse outer frame members 14*c* and 14*d*. The free ends of the transverse members 18*a* and 18*b* then fit snugly against the inner side walls of the longitudinal outer frame members 14*a* and 14*b*. The frame structure 12 is now complete.

(5) Attach the floor 30 to the bottom surfaces of the frame 12, (6) Insert some or all of the vacuum pipes 28*a*-28*i* into corresponding vacuum ports 26*a*-26*i* to obtain the desired configuration of vacuum pipes. For the embodiment of FIGS. 1-3, a vacuum pipe is inserted into each one of the ports and through corresponding holes in the longitudinal inner members to obtain a 9-pipe arrangement 28*a*-28*i* as shown in FIG. 3. For the alternative embodiment of FIGS. 4-6, a vacuum pipe is inserted into alternating vacuum ports such that four vacuum pipes 128*b*, 128*d*, 128*f* and 128*h* are installed. To prepare this embodiment, it is important to use longitudinal inner members 116*a* and 116*b* are which have channels 136*a*-136*f* formed on their lower surfaces to allow vacuum suction to be extended to the middle and rightmost longitudinal areas when the device is in use. These longitudinal members 116*a* and 116*b* also have fewer holes for holding vacuum pipes than the longitudinal members 16*a* and 16*b* of the nine-pipe embodiment of the screened vacuum enclosure.

(7) Lastly, the screen 32 or 132 is attached to the top surfaces of the frame 12 or 112.

(8) Now the vacuum screen enclosure 10 or 110 can be placed on the downstream screen bed of a shaker and attached to a vacuum distributor as described above, with reference to FIGS. 14A and 14B.

Certain embodiments of the kit include one or more screens while other embodiments do not include one or more screens. It may be advantageous to omit the screens from the kits because users may already have inventories of appropriate screens at their work locations. In any case, screens are obtainable from commercial manufacturers and need not be included as components of the kit. It is advantageous to assemble the screened vacuum enclosures at or near the work site so that the screened vacuum enclosures may be customized for the conditions at the site. For example, if a particular class of heavier rock cuttings is present in the drilling fluid as it emerges during the drilling operation, operators may elect to attach a heavier screen to the frame of the kit and to use the nine-pipe configuration of the embodiment of FIGS. 1 to 3.

The kit may include specific step-by step instructions such as those outlined above, to guide users in assembly of screened vacuum enclosures. The instructions may also include specific guidance for assembly and use of different embodiments with different vacuum pipe configurations when specific conditions are expected.

Example 2: Screened Vacuum Enclosures of Embodiment 3 Compatible with the BRANDT™ King Cobra Shaker and the MONGOOSE PRO Shaker The BRANDT™ King Cobra shakers produced by Brandt of Houston, Tex., USA and marketed by National Oilwell Varco and the MONGOOSE PRO shakers marketed by MI Swaco/Schumberger are in wide use in drilling operations. It is advantageous to produce screened vacuum enclosures in accordance with specific embodiments of the present invention which are compatible with these shakers.

The skilled person is to understand that the dimensions of the example embodiments described below are not to be construed as limiting, but are provided simply by way of illustrating certain embodiments with specific examples. Alternative embodiments will have dimensions which vary from these examples if they are designed to be compatible with any other shaker systems. Alternative dimensions can be determined by the skilled person without undue experimentation.

Shown in Tables 1 to 3 are lists of dimensions for screened vacuum enclosures of embodiments 3 to 5 optimized for use in conjunction with the BRANDT King Cobra shaker and a second screened vacuum enclosure optimized for use in conjunction with the MONGOOSE PRO shaker.

TABLE 1

Selected Dimensions and Features for Screened Vacuum Enclosures (Embodiment 3) Configured for Use with the KING COBRA Shaker and the MONGOOSE PRO Shaker

| Selected Dimensions and Features of Specific Screened Vacuum Enclosure Embodiments | Screened Vacuum Enclosure Configured for KING COBRA Shaker | Screened Vacuum Enclosure Configured for MONGOOSE PRO Shaker |
|---|---|---|
| Length of enclosure (inches) | 49¼ | 45⅝ |
| Width of enclosure (inches) | 25 | 22⅝ |
| Height of outer frame members (inches) | 1½ | 1½ |
| Number of vacuum ports | 6 | 6 |
| Diameter of all vacuum ports (inches) | ¾ | ¾ |
| Number of transverse inner support frame members | 7 | 7 |
| Length of transverse inner support frame members (inches) | 23 | 20⅝ |
| Height of inner support frame members (inches) | 1 | 1 |
| Height of spacer elements (inches) | ½ | ½ |
| Length of spacer elements (inches) | 12 | 10 |
| Number of slots | 8 | 8 |
| Length of all slots (inches) | 2¼ | 2¼ |
| Number of narrow slots | 4 | 2 |
| Width of narrow slots (inches) | ¼ | ¼ |
| Number of narrow-intermediate slots | — | 2 |
| Width of narrow-intermediate slots (inches) | — | 5/16 |
| Number of intermediate slots | 2 | 2 |
| Width of intermediate slots (inches) | ⅜ | ⅜ |
| Number of wide slots | 2 | 2 |
| Width of wide slots (inches) | ½ | ½ |

TABLE 2

Selected Dimensions and Features for Screened Vacuum Enclosures (Embodiment 4) Configured for Use with the KING COBRA Shaker and the MONGOOSE PRO Shaker

| Selected Dimensions and Features of Specific Screened Vacuum Enclosure Embodiments | Screened Vacuum Enclosure Configured for KING COBRA Shaker | Screened Vacuum Enclosure Configured for MONGOOSE PRO Shaker |
|---|---|---|
| Length of enclosure (inches) | 49¼ | 45⅝ |
| Width of enclosure (inches) | 25 | 22⅝ |
| Height of outer frame members (inches) | 1½ | 1½ |
| Number of vacuum ports | 4 | 4 |
| Diameter of all vacuum ports (inches) | ¾ | ¾ |
| Number of transverse inner support frame members | 4 | 4 |
| Height of inner support frame members (inches) | 1½ | 1½ |
| Number of slots | 2 | 2 |
| Length of all slots (inches) | 2¼ | 2¼ |

TABLE 3

Selected Dimensions and Features for Screened Vacuum Enclosures (Embodiment 5) Configured for Use with the KING COBRA Shaker and the MONGOOSE PRO Shaker

| Selected Dimensions and Features of Specific Screened Vacuum Enclosure Embodiments | Screened Vacuum Enclosure Configured for KING COBRA Shaker | Screened Vacuum Enclosure Configured for MONGOOSE PRO Shaker |
|---|---|---|
| Length of enclosure (inches) | 49¼ | 45⅝ |
| Width of enclosure (inches) | 25 | 22⅝ |
| Height of outer frame members (inches) | 1½ | 1½ |
| Number of vacuum ports | 1 | 1 |
| Diameter of single adapter-based vacuum port (inches) | ⅞ | ⅞ |
| Number of transverse inner support frame members | 4 | 4 |
| Height of inner support frame members (inches) | 1½ | 1½ |
| Length of single slot in front frame member (inches) | 13¼ | 13¼ |

EQUIVALENTS AND SCOPE

Other than described herein, or unless otherwise expressly specified, all of the numerical ranges, amounts, values and percentages, such as those for amounts of materials, elemental contents, times and temperatures, ratios of amounts, and others, in the following portion of the specification and attached claims may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Any patent, publication, internet site, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Unless otherwise defined, all technical and scientific terms used herein have the same meaning as commonly understood by one of ordinary skill in the art to which this invention belongs.

While this invention has been particularly shown and described with references to embodiments thereof, it will be understood by those skilled in the art that various changes in form and details may be made therein without departing from the scope of the invention encompassed by the appended claims.

The invention claimed is:

1. A screened vacuum enclosure for use in separating drilling fluid from drill cuttings in a vacuum-based shaker system, the screened vacuum enclosure comprising:

a) a rectangular frame including downstream and upstream longitudinal outer frame members and transverse outer frame members, with one or more vacuum ports extending through or into one of the longitudinal outer frame members, the vacuum ports communicating vacuum suction to the interior of the screened vacuum enclosure;

b) one or more inner frame support members connected to the outer frame members;

c) a screen attached to the top surface of the frame; and d) a floor attached to at least part of the bottom surface of the frame;

wherein the vacuum ports extend through the outside front surface of the downstream longitudinal frame member to the interior of the frame;

wherein the one or more inner frame support members include longitudinal and transverse inner frame members dividing the inside of the rectangular frame into a plurality of interior sections and wherein vacuum pipes are placed in at least some of the vacuum ports, the vacuum pipes having open ends located in at least some of the interior sections; and wherein the inner frame support members comprise two longitudinal inner frame members and two transverse inner frame members dividing the interior of the rectangular frame into a grid with nine interior sections, and defining three interior longitudinal areas and three interior transverse areas.

2. The screened vacuum enclosure of claim 1, including nine substantially equi-spaced vacuum ports.

3. The screened vacuum enclosure of claim 2, wherein the vacuum ports are round and have interior threaded sidewalls for installation of one or more threaded plugs.

4. The screened vacuum enclosure of claim 2, including nine vacuum pipes with one vacuum pipe placed in each one of the nine vacuum ports.

5. The screened vacuum enclosure of claim 4, wherein one pipe of the nine vacuum pipes terminates in each one of the nine interior sections.

6. The screened vacuum enclosure of claim 5, wherein each of the three transverse areas includes three vacuum pipes of the nine vacuum pipes with one of the three vacuum pipes terminating in each of the three interior sections included in each of the three transverse areas.

7. The screened vacuum enclosure of claim 3, including four vacuum pipes installed in the second, fourth, sixth and eighth vacuum ports of the nine vacuum ports and wherein the plugs are installed in the first, third, fifth, seventh and ninth vacuum ports of the nine vacuum ports.

8. The screened vacuum enclosure of claim 7, wherein each one of the four vacuum pipes extends across the three longitudinal areas and terminates in the longitudinal area adjacent the longitudinal outer frame member opposing the longitudinal outer frame member with the vacuum ports.

9. The screened vacuum enclosure of claim 7, wherein each of the two inner longitudinal frame members includes three equi-spaced channels adjacent the floor to allow vacuum suction to extend to longitudinal sections that do not include the open ends of the vacuum pipes.

10. A screened vacuum enclosure for use in separating drilling fluid from drill cuttings in a vacuum-based shaker system, the screened vacuum enclosure comprising:

a) a rectangular frame including downstream and upstream longitudinal outer frame members and transverse outer frame members, with one or more vacuum ports extending through or into one of the longitudinal outer frame members, the vacuum ports communicating vacuum suction to the interior of the screened vacuum enclosure;

b) one or more inner frame support members connected to the outer frame members;

c) a screen attached to the top surface of the frame; and d) a floor attached to at least part of the bottom surface of the frame;

wherein the vacuum ports extend through the outside front surface of the downstream longitudinal frame member to the interior of the frame; and wherein at least some of the outer frame members are at least partially hollow and are joined to form a continuous hollow space within the rectangular frame, and wherein the vacuum ports join the hollow space and communicate vacuum suction to the interior of the screened vacuum enclosure via one or more additional openings in the rectangular frame.

11. The screened vacuum enclosure of claim 10, wherein the additional openings are provided by one or more slots located in one or more of the longitudinal or transverse outer frame members.

12. The screened vacuum enclosure of claim 11, wherein the one or more slots is eight slots substantially equi-spaced across the length of the interior side of the upstream longitudinal outer frame member, and wherein the downstream outer frame member includes six substantially equi-spaced vacuum ports.

13. The screened vacuum enclosure of claim 12 wherein the eight slots have substantially identical lengths and different widths, with widest slots located at the center of the upstream longitudinal member, and with narrowest slots located adjacent to the ends of the upstream longitudinal member.

14. The screened vacuum enclosure of claim 13, wherein the slots each have radiused corners.

15. The screened vacuum enclosure of claim 11, wherein the slots have a total open area greater than the total open area of the plurality of vacuum ports.

16. The screened vacuum enclosure of claim 10, wherein the outer frame has mitered corners and each end of the downstream longitudinal frame member has a vacuum port extending into a corresponding mitered corner of the mitered corners.

17. The screened vacuum enclosure of claim 10, wherein the one or more inner frame support members is seven transverse inner frame support members.

18. The screened vacuum enclosure of claim 17, further comprising seven spacer elements located between corresponding transverse inner frame support members and the floor, the spacer elements having a length less than the length of the transverse inner frame support members, thereby providing upstream and downstream spaces between the transverse inner frame support members and the floor.

19. The screened vacuum enclosure of claim 11, wherein the floor covers between about one quarter to about three quarters of the interior area of the rectangular frame and is bounded by the entire length of the downstream longitudinal member, the entire length of an opposing inner longitudinal support member and opposing portions of the transverse outer frame members.

20. The screened vacuum enclosure of claim 19, wherein the floor covers about half of the interior area.

21. The screened vacuum enclosure of claim 19, wherein the one or more slots is provided by a pair of opposing slots located in the portions of the transverse outer frame members, and wherein the portions of the transverse outer frame members each have an interior boundary limiting the interior hollow space.

22. The screened vacuum enclosure of claim 21, wherein the interior boundary in each transverse outer frame member is located adjacent to the upstream end of each of the opposing slots.

23. The screened vacuum enclosure of claim 19, wherein the floor has two sloped portions increasing in height from the opposing portions of the transverse outer frame members to a substantially central apex.

24. The screened vacuum enclosure of claim 23, wherein the floor is supported by a central reinforcing member attached to the underside of the floor and the upstream interior area of the rectangular frame not covered by the floor includes one or more transverse inner frame members.

25. A screened vacuum enclosure for use in separating drilling fluid from drill cuttings in a vacuum-based shaker system, the screened vacuum enclosure comprising:

a) a rectangular frame including downstream and upstream longitudinal outer frame members and transverse outer frame members, with one or more vacuum ports extending through or into one of the longitudinal outer frame members, the vacuum ports communicating vacuum suction to the interior of the screened vacuum enclosure;

b) one or more inner frame support members connected to the outer frame members;

c) a screen attached to the top surface of the frame; and d) a floor attached to at least part of the bottom surface of the frame, and wherein the one or more vacuum ports is provided by a single vacuum port located in an adapter inserted in a slot in the downstream outer frame member which is open to the interior of the frame.

26. The screened vacuum enclosure of claim 25, wherein the adapter includes (i) an elongated base with a plug portion configured to fit into the slot and (ii) an outward extending funnel-shaped portion terminating with the vacuum port.

27. The screened vacuum enclosure of claim 26, wherein the elongated base is defined by having one or more bolt or screw holes for connection of the adapter to the downstream outer frame member.

28. The screened vacuum enclosure of claim 25, wherein the floor covers between about one quarter to about three quarters of the interior area of the rectangular frame and is bounded by the entire length of the downstream longitudinal member, the entire length of an opposing inner longitudinal support member and opposing portions of the transverse outer frame members.

29. The screened vacuum enclosure of claim 28, wherein the floor covers about half of the interior area.

30. The screened vacuum enclosure of claim 29, wherein the floor has three sloped sections with first and second triangular sections sloping downward from downstream corners of the rectangular frame and a central trapezoidal section sloping downward from the inner longitudinal support member to the downstream longitudinal frame member.

* * * * *